US007604012B2

(12) United States Patent
Alpert et al.

(10) Patent No.: US 7,604,012 B2
(45) Date of Patent: Oct. 20, 2009

(54) DISHWASHER AND METHOD

(75) Inventors: Martin A. Alpert, 26061 Annesley Rd., Beachwood, OH (US) 44122; William Bruml, Cleveland Heights, OH (US); Warren A. Sklar, Beachwood, OH (US)

(73) Assignee: Martin A. Alpert, Beachwood, OH (US)

( * ) Notice: Subject to any disclaimer, the term of this patent is extended or adjusted under 35 U.S.C. 154(b) by 583 days.

(21) Appl. No.: 10/926,765

(22) Filed: Aug. 26, 2004

(65) Prior Publication Data

US 2005/0072449 A1 Apr. 7, 2005

Related U.S. Application Data

(60) Provisional application No. 60/498,177, filed on Aug. 26, 2003, provisional application No. 60/525,083, filed on Nov. 25, 2003, provisional application No. 60/542,251, filed on Feb. 5, 2004, provisional application No. 60/554,654, filed on Mar. 19, 2004.

(51) Int. Cl.
*B08B 3/00* (2006.01)

(52) U.S. Cl. ..... 134/58 D; 134/25.2; 134/58 R

(58) Field of Classification Search ..... 134/56 D, 134/57 D, 61, 66, 67, 68, 70, 115 R, 58 D, 134/58 R, 71, 75, 25.2
See application file for complete search history.

(56) References Cited

U.S. PATENT DOCUMENTS 1,798,428 A * 3/1931 Lindgren ..... 134/93
1,907,152 A 5/1933 Fielding
1,934,539 A 11/1933 Henderson
2,277,291 A 3/1942 Blair
2,418,691 A * 4/1947 Bjering et al. ..... 134/81
2,532,925 A * 12/1950 Loeb ..... 15/74

(Continued)

FOREIGN PATENT DOCUMENTS

EP 0650692 A1 5/1995

(Continued)

OTHER PUBLICATIONS

International Search Report for International Application No. PCT/US 2004/027794, Mar. 8, 2005.

(Continued)

*Primary Examiner*—Michael Barr
*Assistant Examiner*—Rita R Patel
(74) *Attorney, Agent, or Firm*—Renner, Otto, Boisselle & Sklar, LLP

(57) ABSTRACT

A personal dishwasher washes and dries a dish that is manually or mechanically moved through a dishwasher chamber or is manually placed in and manually removed from the chamber. Pressurized water, possibly containing soap, wetting agent, etc., may be added to the wash water. Steam may be used to for cleaning and/or disinfecting. Ultraviolet light may be used for disinfecting. The dishwasher chamber may be enlarged to pass larger dishes, bowls, glassware, etc. for washing. A method of washing dishes, comprising inserting a dish manually into a dishwasher, passing the dish through the dishwasher, and withdrawing the dish. A method of washing a dish, comprising inserting a single dish into a dishwasher, directing fluid under pressure at the dish, directing air flow at the dish, and withdrawing the dish.

33 Claims, 15 Drawing Sheets

U.S. PATENT DOCUMENTS

| | | | | | |
|---|---|---|---|---|---|
| 2,651,065 | A | | 9/1953 | O'Connor | |
| 3,072,128 | A | | 1/1963 | Duane | |
| 3,656,491 | A | * | 4/1972 | Ballard | 134/56 R |
| 3,663,979 | A | | 5/1972 | Shaw | |
| 3,800,813 | A | | 4/1974 | Noren | |
| 4,135,531 | A | | 1/1979 | Federighi et al. | |
| 4,174,722 | A | * | 11/1979 | Fleenor et al. | 134/62 |
| 4,223,418 | A | | 9/1980 | Pedrini et al. | |
| 4,231,806 | A | | 11/1980 | Henry | |
| 4,235,642 | A | | 11/1980 | Federighi et al. | |
| 4,285,352 | A | | 8/1981 | McMahon et al. | |
| 4,366,005 | A | | 12/1982 | Oguri et al. | |
| 4,561,144 | A | | 12/1985 | Marais et al. | |
| 4,683,009 | A | * | 7/1987 | Shriver | 134/30 |
| 5,267,580 | A | * | 12/1993 | Payzant | 134/57 D |
| 5,449,011 | A | | 9/1995 | Jacobus et al. | |
| 5,470,142 | A | | 11/1995 | Sargeant et al. | |
| 5,581,836 | A | | 12/1996 | Kleber et al. | |
| 5,619,767 | A | | 4/1997 | Larson | |
| 5,687,752 | A | | 11/1997 | Boylan | |
| 5,875,800 | A | * | 3/1999 | Hulskotte | 134/56 R |
| 5,882,739 | A | * | 3/1999 | Kobos et al. | 427/536 |
| 6,092,540 | A | | 7/2000 | Chiao et al. | |
| 6,422,180 | B1 | | 7/2002 | Yiu | |
| 6,578,586 | B2 | | 6/2003 | Moh | |
| 6,705,330 | B1 | | 3/2004 | Favret | |
| 2002/0153021 | A1 | * | 10/2002 | Audet | 134/1 |
| 2003/0024554 | A1 | * | 2/2003 | Schultz et al. | 134/33 |

FOREIGN PATENT DOCUMENTS

| | | | |
|---|---|---|---|
| EP | 0688607 | A1 | 12/1995 |
| EP | 1281347 | A1 | 2/2003 |
| GB | 687 379 | | 2/1953 |
| GB | 2 148 702 | | 6/1985 |
| JP | 01022233 | | 1/1989 |
| JP | 03039134 | | 2/1991 |
| JP | 06197857 | | 7/1994 |
| JP | 07150864 | | 6/1995 |
| JP | 09108160 | | 4/1997 |
| JP | 10258013 | | 9/1998 |
| JP | 11021962 | | 1/1999 |
| JP | 2002065548 | | 3/2002 |
| JP | 2003061766 | | 3/2003 |
| JP | 2003235778 | | 8/2003 |
| WO | WO 03055373 | A1 | 7/2003 |

OTHER PUBLICATIONS

International Search Report for International Application No. PCT/US 2004/027794, mailed Sep. 20, 2005.

* cited by examiner

FIG. 7
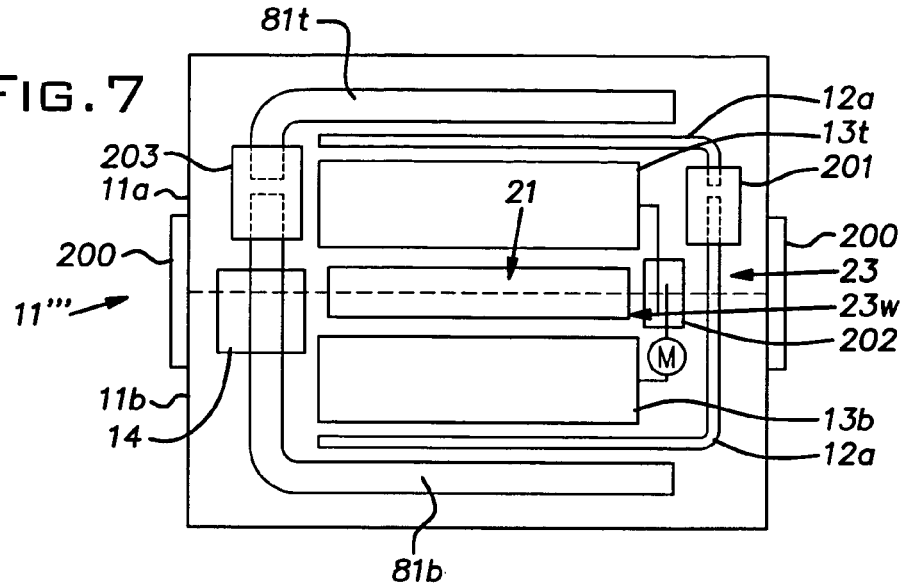
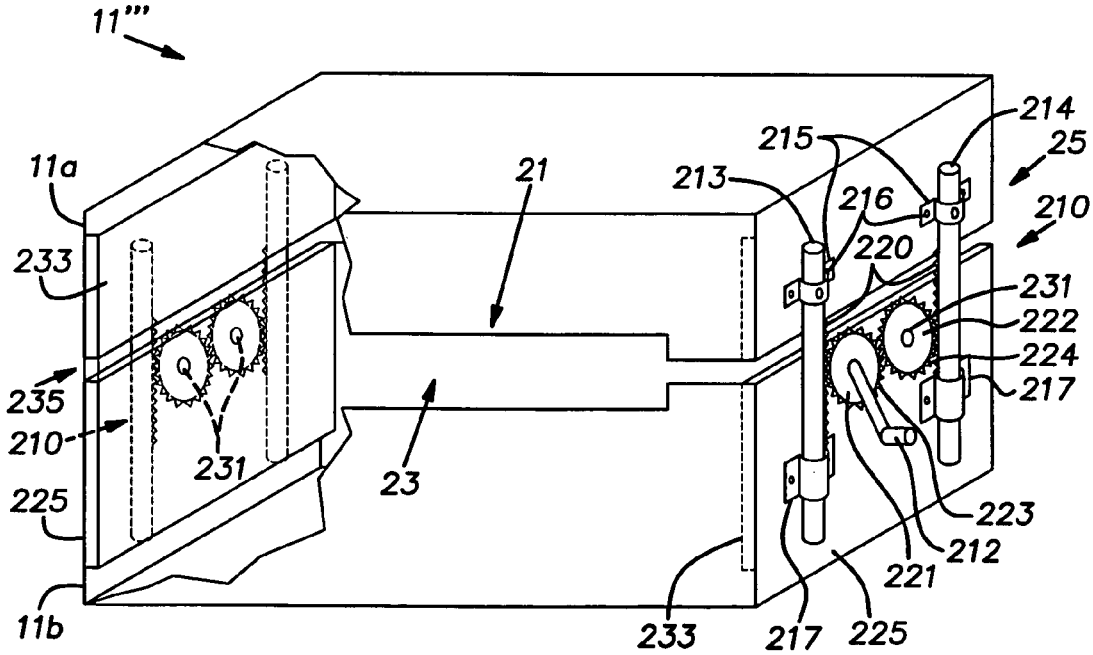
FIG. 8

FIG. 15
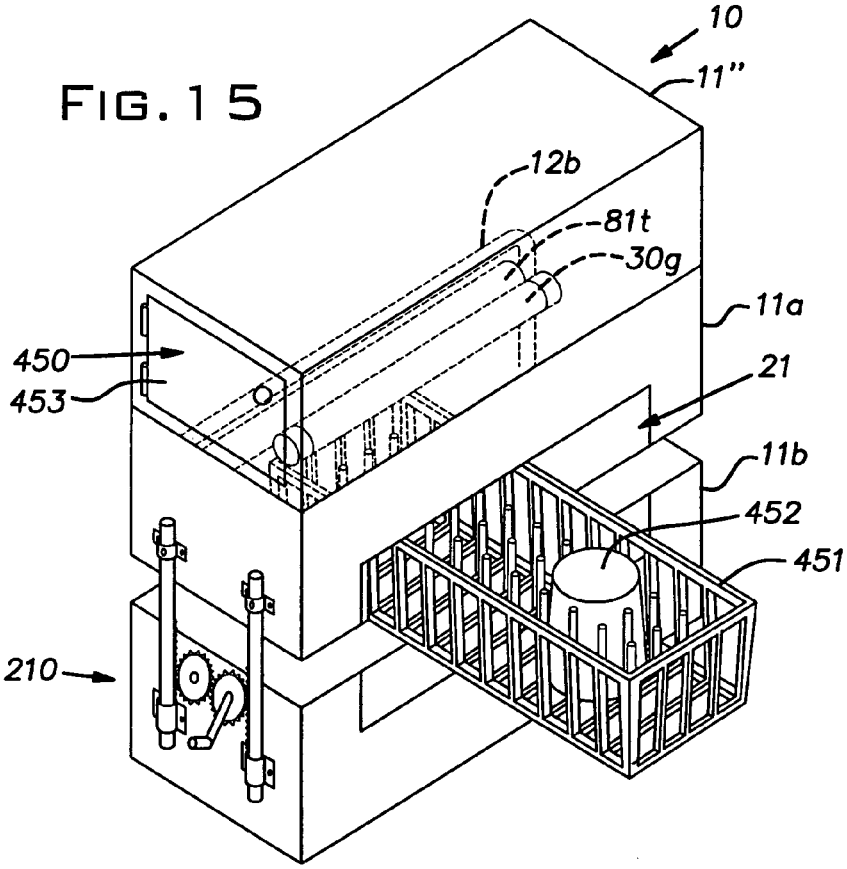
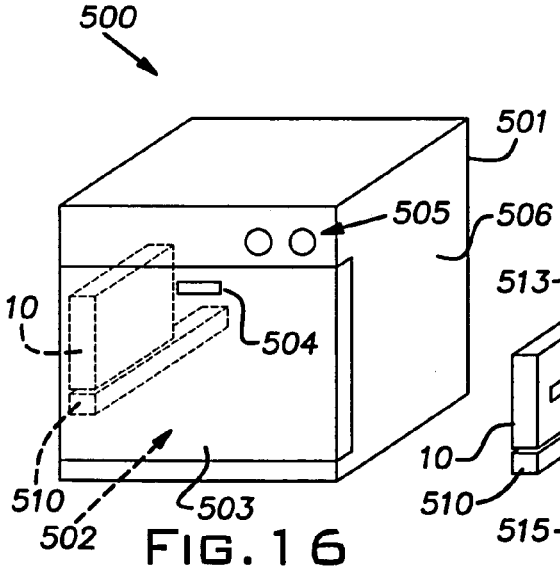
FIG. 16
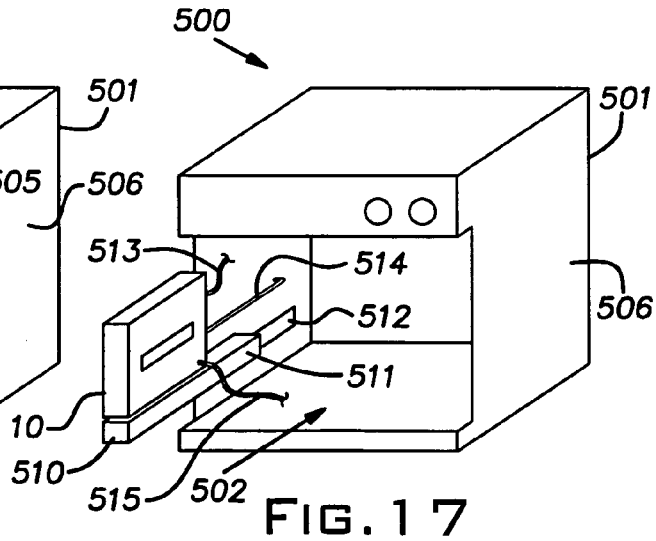
FIG. 17

DISHWASHER AND METHOD

CROSS-REFERENCE TO RELATED APPLICATIONS

This application claims the benefit of four U.S. Provisional Patent Applications Ser. No. 60/498,177, filed Aug. 26, 2003, Ser. No. 60/525,083, filed Nov. 25, 2003, Ser. No. 60/542,251, filed Feb. 5, 2004, and Ser. No. 60/554,654, filed Mar. 19, 2004, the entire disclosures of which are hereby incorporated by reference.

TECHNICAL FIELD

The present invention relates generally, as indicated, to dishwashers and methods of washing dishes and the like, and, more particularly, to a relatively small dishwasher and method useful to wash quickly one or several dishes and/or sequentially a number of dishes. Exemplary dishwashers in accordance with the present invention may be relatively small, fixed or portable, efficient, and convenient to use to wash dishes, silverware, glasses, pots, pans, etc.

BACKGROUND

As used herein, reference to "washing" may include washing and drying dishes. Also, as used herein, reference to "dishes" includes dishes, glassware, bowls, pots, pans, silverware, serving utensils, glasses, cups, etc.

Various types of conventional dishwashers are commercially available, for example, for home use as built in units, for home use as portable units, and for commercial use. Conventional dishwashers are relatively large and require substantial floor space if free standing or require substantial under counter space if built in. Each conventional dishwasher typically has one or more racks in which the objects, such as dishes, glassware, pots, pans, silverware, etc. are placed. The rack is positioned in a housing or a cabinet. Water is directed to the objects intended to be washed. Drying usually is accomplished by an air flow through the housing and/or heat. It takes time, for example, several minutes, fully to load a conventional dishwasher, several minutes to unload it, and from about 30 to 60 minutes for washing and drying cycles of operation. There is a possibility of breakage of a dish in case one is pushed off its rack position by the water jets or of ineffective washing if a dish or utensil slips out of place and falls and blocks the rotating mechanism that sprays the water. Furthermore, it may take a fairly long time to wash a rack of dishes, regardless of the number of dishes in the rack; this can be a problem at home if only a small number of dishes are owned and the same dish or same-size dish may be required for use in multiple courses during a dinner. Operating a dishwasher through its entire cycle to wash only a few dishes can waste much energy, water and time. Even in a restaurant it may be desirable quickly to wash a single dish or only several dishes and may unnecessarily contribute to environmental pollution as soap is discharged into the sewer system.

Such conventional dishwashers require a large space. Sometimes the space is not conveniently available, e.g., in a relatively small kitchen or in a motorhome, airplane or boat. Even in a relatively large kitchen a large dishwasher requires space that may otherwise be used for storage.

Accordingly, there is a need for a fast acting dishwasher with a small footprint and volume. There also is a need for a dishwasher able conveniently to wash efficiently a small number of dishes or even a single dish.

SUMMARY

In the description herein and also in the claims reference may be made to dishes or to a dish, one example being a dinner plate of conventional style having a top, a bottom, and a circumference that may be round, oblong, polygonal, have respective corners, etc. However, it is intended that reference to the word dishes and the word dish would include other objects that typically are used for eating and serving (e.g., a plate or bowl), for food preparation (e.g., a pot or pan), for food storage or serving (e.g., a bowl or other container), as well as eating utensils (e.g., fork, knife, spoon, etc.), and/or drinking objects or utensils (e.g., drinking glasses, cups, mugs, stemware, etc.), and the like. Thus, unless context or specific description below indicates or implies, reference below to "dish" or "dishes" means various items that my be washed in a dishwasher.

The terms "personal dishwasher" or "personalized dishwasher" means a dishwasher for washing only a single dish or several dishes, e.g., from one to several dishes. Some aspects of the invention are pertinent to a personal dishwasher; other aspects may pertain to personal dishwashers and to conventional dishwashers.

One aspect of the invention relates to a relatively small dishwasher able efficiently to wash one or several dishes.

An aspect relates to a small, fast acting dishwasher able to wash one dish at a time, but operable relatively quickly so that several dishes can be washed sequentially.

Another aspect relates to a personal dishwasher having a washing chamber in which one or several dishes may be placed, and a fluid inlet through which fluid may be directed to wash a dish.

Another aspect relates to a dishwasher including a washing zone, and a path in which a dish or the like may be manually inserted to and removed from the washing zone.

One or more other aspects that may be used singly or used in one or more combinations associated with one or more of the dishwashers and methods described herein include a fluid dispenser to dispense fluid to the dish or the like for washing, brushes for brushing against the dish or the like in the washing zone, a steam flow to direct a flow of steam to the dish or the like to clean the dish or at least to assist in cleaning, a source of ultraviolet radiation for irradiating the dish or the like, detergent dispensing, a biodegradable chemical wash for washing the dish or the like in the washing zone, a source of plasma for at least partly cleaning the dish or the like in the washing zone, a source of ultrasonic energy for at least partly cleaning the dish or the like in the washing zone, a source of heat for heating the dish and/or the water, and/or a control for one or more of the foregoing.

Another aspect relates to a dishwasher, including a housing having a washing zone, and a storage area in a cabinet or counter, the dishwasher being movable onto the counter from the cabinet or from some other location relative to the counter for use to wash dishes or the like.

Another aspect relates to a dishwasher, including a number of brushes, straps, and/or the like, which may be removable and/or replaceable, arranged to wipe against a dish, a device to move the brushes to wipe such dish as it is passed through the dishwasher, a liquid inlet to direct liquid toward the dish, the brushes and liquid inlet being positioned to direct liquid onto such dish and to wipe against the dish, respectively, as the dish is moved relative to the liquid inlet and brushes.

Another aspect relates to a dishwasher including at least one outlet to direct at least one of rinse water, wash water, steam or air toward a dish for washing and/or drying the same, a cabinet having a dishwashing chamber, a chamber in which the dish is washed, and control and distribution for at least one of rinse water, wash water, steam and/or air.

Another aspect relates to a dishwasher including at least one outlet to direct at least one of rinse water, wash water, steam or air toward a dish for washing and/or drying the same, a cabinet having a dishwashing chamber, several chambers in which respective dishes are washed, and control and distribution for at least one of rinse water, wash water, steam and/or air.

Another aspect relates to a dishwasher, including a water spray device to direct liquid to a dish to be washed, brushes to brush against top and bottom of a dish, and wherein the brushes are positioned relative to each other to provide at least partial support for a dish thereby.

Another aspect relates to a flow through dishwasher, including a housing through which a dish may be passed along a path for washing thereof, an inlet to the housing through which the dish may be passed, water spray and/or brushes for washing the dish as it is passed through the housing, and an outlet from the housing through which the washed dish may be retrieved.

Another aspect relates to a method of washing dishes including, while manually holding such a dish, (a) placing the dish to be washed in a dishwasher, (b) directing liquid at the dish to be washed, (c) in the dishwasher brushing the dish to be washed to clean the dish, and (d) removing the washed dish from the dishwasher.

Another aspect relates to an instant dishwasher, including a housing, a washing chamber in the housing, a liquid director to direct liquid to wash a dish in the chamber, brushes in the chamber for brushing against a dish to clean the dish, and an inlet and outlet for the chamber, respectively, to place a dish in the chamber and to remove the dish from the chamber.

Another aspect relates to a quick acting dishwasher, including a housing, a travel path through the housing for a dish or the like to be washed, a number of cleaning members in the housing to clean a dish moving through the housing along the travel path, an inlet for passing a dish into the housing along the travel path and an outlet from the housing through which a dish may be removed, the distance between the inlet and outlet being such that a dish may be manually held both at the inlet and at the outlet while and during at least part of the process of passing the dish along the travel path for washing.

Another aspect relates to a dishwasher, including a housing having a washing zone, and a storage area beneath the top surface of a cabinet or counter, the dishwasher being positionable stored in the storage area and movable to a position at least substantially at the top surface for use to wash dishes or the like.

Another aspect relates to a dishwasher of the type described mounted with respect to a barbeque grill.

Another aspect relates to a double sink with a dishwasher between the two sinks to allow passing a dish from one sink through the dishwasher into the other sink.

Another aspect relates to a two chamber dishwasher in which one dish can be placed in one chamber for washing, and an already washed dish in the other chamber can be removed, and wherein such operation is sequential.

Another aspect relates to a method of washing dishes whereby one dish is placed in a dishwasher for washing, a second dish is removed from the dishwasher after the first-mentioned dish has been placed for washing, and the sequence is repeated.

Another aspect relates to a method of washing dishes whereby two hands are used sequentially, whereby one hand may place a dish in a dishwasher for washing and the other hand removes an already washed dish from the dishwasher, thereby minimize time for washing dishes and making the time seem shorter since constant activity is occurring.

Another aspect relates to a method of washing dishes whereby two hands are used sequentially, whereby one hand may place a dish in a dishwasher for washing and the other hand removes an already washed dish from the dishwasher.

Another aspect relates to a dishwasher mounted on, beneath or otherwise with respect to a table, e.g., a dining room table, kitchen table or the like.

Another aspect relates to a method of and apparatus for washing dishes by drawing dishes past jet sprays.

Another aspect relates to a method of and apparatus for washing dishes by shuttling or transporting dishes between a loading/unloading zone and a washing zone.

Another aspect relates to a method of washing and/or drying a dish by manually holding a dish and manually moving the dish through a washing and/or drying zone of a dishwasher.

Another aspect relates to a dishwasher for washing dishes that are manually moved through a washing and/or drying zone.

Another aspect relates to a dishwasher, including a housing, a washing zone, an inlet in the housing to provide access to the washing zone, and the housing be adjustable to change the size of the inlet.

Another aspect relates to using particulate material to clean a dish in a dishwasher.

Another aspect relates to using ultraviolet illumination or light in a relatively shielded area to help disinfect dishes.

Another aspect relates to concentrating and/or confining ultraviolet illumination or light in to help disinfect dishes.

An aspect of the invention relates to a dishwasher including at least one outlet to direct at least one of rinse water, wash water, steam or air toward a dish for washing and/or drying the same, a cabinet having a dishwashing chamber, a support for a dish, and control and distribution for at least one of rinse water, wash water, steam and/or air.

Another aspect relates to a dishwasher, comprising a number of brushes arranged to wipe against an object used for eating, preparing or serving food, a device to move the brushes to wipe such object as it is passed through the dishwasher, a liquid outlet to direct liquid toward the object, the brushes and liquid outlet being positioned to direct liquid onto such object and to wipe against the object, respectively, as the object is moved relative to the liquid outlet and brushes.

Another aspect relates to a dishwasher, comprising a water spray device to direct liquid to an object to be washed, brushes to brush against top and bottom of an object to be washed, and wherein the brushes are positioned relative to each other to provide at least partial support for an object being washed thereby.

Another aspect relates to a flow through dishwasher, comprising a housing through which an object in the shape of an object in the shape of at least one of a dish, food preparation device and food eating implement may be passed along a path for washing thereof, an inlet to the housing through which the object may be passed, water spray and/or brushes for washing the object as it is passed through the housing, and an outlet from the housing through which the washed object may be retrieved.

Another aspect relates to a method of washing objects used for at least one of food preparation, serving and storing, comprising while manually holding such an object, a) placing the object to be washed in a dishwasher, b) directing liquid at the object to be washed, c) in the dishwasher brushing the object to be washed to clean the object, and d) removing the washed object from the dishwasher.

Another aspect relates to an instant dishwasher, comprising a housing, a washing chamber in the housing, a liquid director to direct liquid to wash a dish in the chamber, brushes in the chamber for brushing against a dish to clean the dish, and an inlet and outlet for the chamber to place a dish in the chamber and to remove the dish from the chamber.

Another aspect relates to a quick acting dishwasher, comprising a housing, a travel path through the housing for a dish or the like to be washed, a number of cleaning members in the housing to clean a dish moving through the housing along the travel path, an inlet for passing a dish into the housing along the travel path and an outlet from the housing through which a dish may be removed, the distance between the inlet and outlet being such that a dish may be manually held both at the inlet and at the outlet while and during at least part of the process of passing the dish along the housing for washing.

Another aspect relates to a dishwasher, comprising a washing zone, and a path in which a dish or the like may be manually inserted to and removed from the washing zone.

Another aspect relates to a dishwasher, comprising a housing having a washing zone, and a storage area in a cabinet or counter, the dishwasher being movable onto the counter from the cabinet or counter for use to wash dishes or the like.

Another aspect relates to a dishwasher, comprising a housing having a washing zone, and a storage area beneath the top surface of a cabinet or counter, the dishwasher being positionable stored in the storage area and movable to a position at least substantially at the top surface for use to wash dishes or the like.

Another aspect relates to a dishwasher, comprising a housing, a washing zone, an inlet in the housing to provide access to the washing zone, and the housing be adjustable to change the size of the inlet.

Another aspect relates to a dishwasher having a steam flow therein, and a water curtain for blocking flow of steam outside the dishwasher.

Another aspect relates to a dishwasher, comprising a washing zone and at least one steam zone for directing steam to a dish or other object for washing the same.

Another aspect relates to a dishwasher having a washing zone and an air curtain to isolate the washing zone from the environment external of the dishwasher.

Another aspect relates to a dishwashing method, comprising directing a flow of steam at a dish to wash the dish.

Another aspect relates to a dishwasher, comprising a housing having a washing zone, and external of the housing a steam dispenser.

Another aspect relates to a washing device for dishes and the like, comprising a portable holder, and at least one brush that is movable relative to the holder.

Another aspect relates to a combination dishwasher comprising a dishwasher having a dishwashing chamber and a personalized dishwasher mounted in a stored location in the dishwashing chamber and moveable to operative position to wash dishes.

Another aspect relates to a dishwasher, comprising a dishwashing chamber and a switch responsive to a dish, glass or the like in the dishwashing chamber to control operation of the dishwasher.

Another aspect relates to a dishwasher, comprising a rack having steam dispensing openings for dispensing seam in close proximity to an object to be washed.

Another aspect relates to a rack for a dishwasher, comprising a number of pole-like members, and at least one of the pole-like members having one or more openings to dispense steam therefrom.

One or more of the above and other aspects, objects, features and advantages of the present invention are accomplished using the invention described and claimed below. Also it will be appreciated that a part or feature, etc. shown in one embodiment or drawing may be used in the same or a similar way in another embodiment.

To the accomplishment of the foregoing and related ends, the invention, then, comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed.

Although the invention is shown and described with respect to certain embodiments, it is obvious that equivalents and modifications will occur to others skilled in the art upon the reading and understanding of the specification. The present invention includes all such equivalents and modifications, and is limited only by the scope of the claims.

BRIEF DESCRIPTION OF THE DRAWINGS

The annexed drawings are not necessarily to scale and may be somewhat schematic. Directions are shown for convenience of illustration and description but may not necessarily be limiting to the direction of orientation and operation of respective parts. Reference numerals with a prime indication, e.g., 1', may be used to designate parts that are similar in structure and function or are equivalent to a corresponding part designated by an unprimed reference numeral.

In the annexed drawings,

FIGS. 7 and 8 are schematic illustrations of a dishwasher having an adjustable height and opening feature;

FIG. 15 is a schematic illustration of a dishwasher having a compartment for storing a tray for carrying glasses and/or other objects through the dishwasher with a tray inserted in the dishwasher to carry a drinking glass through the dishwasher;

FIG. 16 is a schematic illustration of a conventional dishwasher having built in a dishwasher in accordance with the present invention;

FIG. 17 is a schematic illustration of the dishwasher of FIG. 16 with the front door removed to show the interior of the dishwashing compartment and showing a dishwasher in accordance with present invention positioned ready to be used to wash dishes;

DESCRIPTION

Figure 1A:
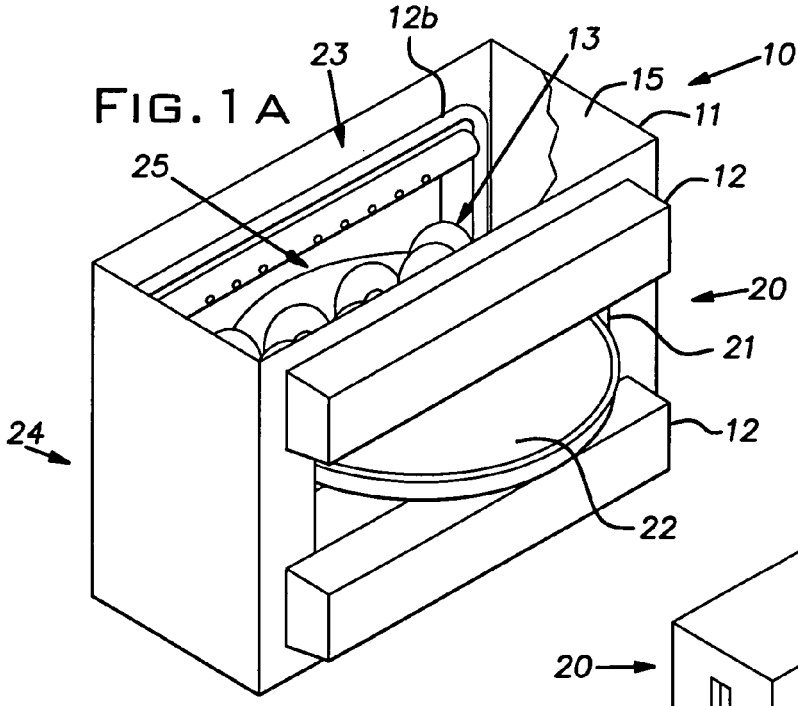
FIG. 1A is an isometric view of a dishwasher in accordance with an embodiment of the present invention, part of the top of the dishwasher having been removed to allow viewing of part of the inside of the dishwasher housing.
Figure 1B:
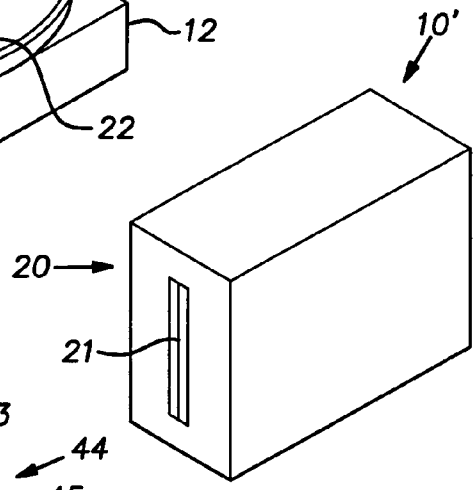
FIG. 1B is a schematic illustration of dishwasher having a vertical orientation to provide for dishes to be washed in a generally vertical orientation.
Figure 3:
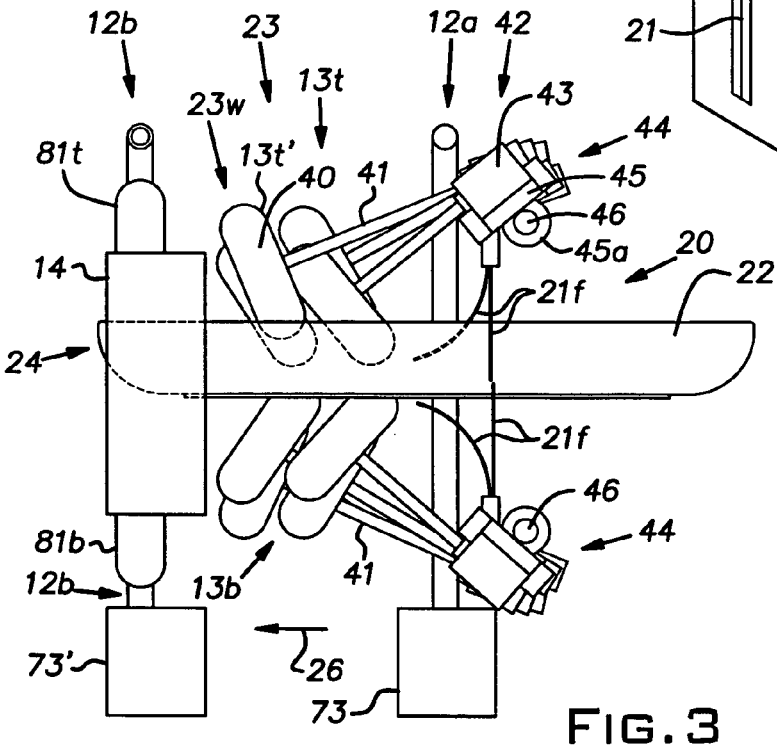
FIG. 3 is an end elevation view of the dishwasher with the housing removed looking generally in the direction of the arrows 3-3 of FIG. 2 and a dish therein.
Figure 2:
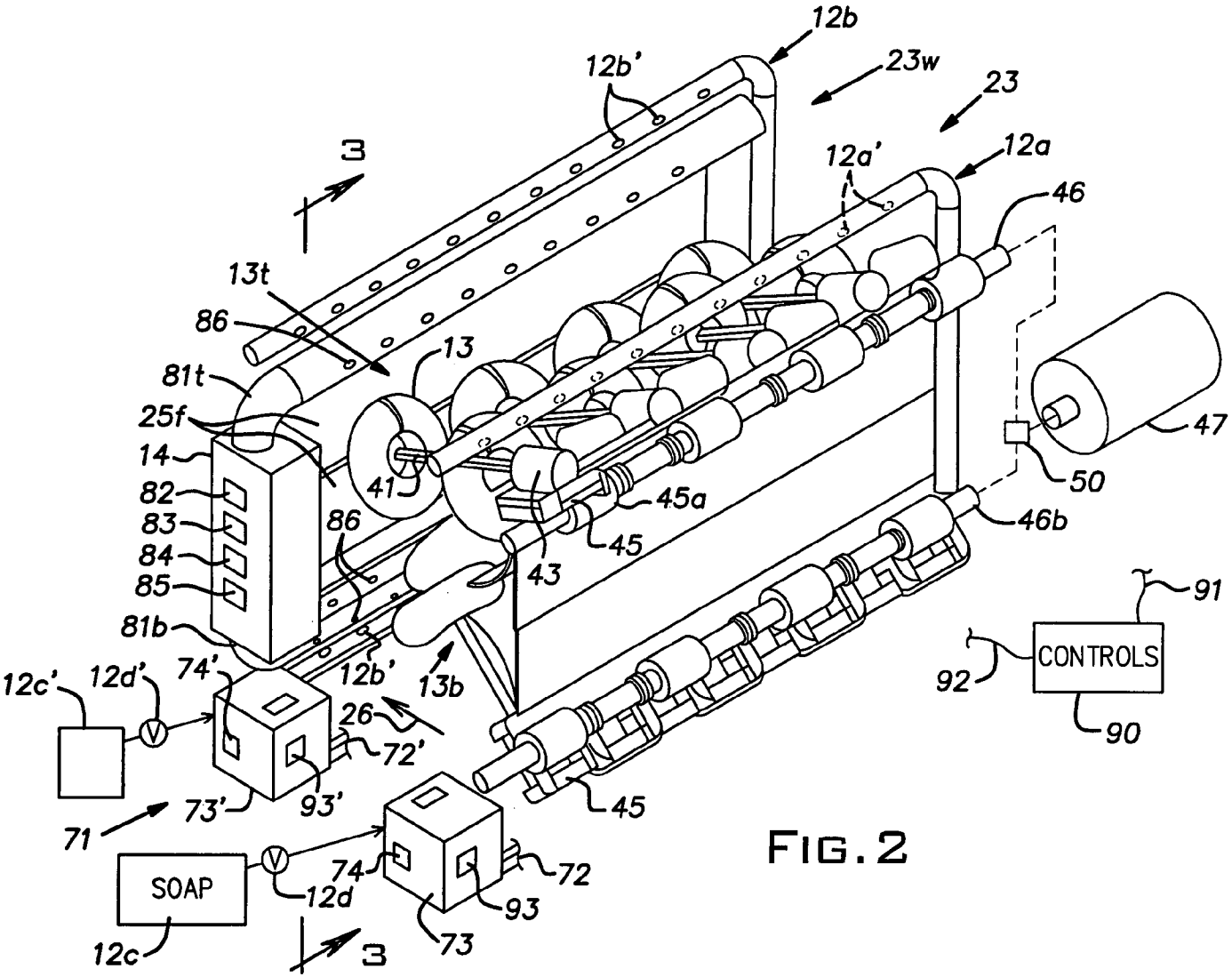
FIG. 2 is an isometric view of the dishwasher with the housing removed.

Referring in detail to the drawings, wherein like reference numerals designate like parts in the several figures, and initially to FIGS. 1-3, a dishwasher in accordance with the present invention is indicated at 10. Although the description herein refers to a dishwasher, it will be appreciated, as was described above, that the dishwasher may be used to wash dishes (including silverware, pots, pans, glasses, etc.) or other objects, e.g., clothes, towels, and/or other objects, several examples of which are presented above in the summary portion of this patent application. The dishwasher 10 is relatively compact and it may be portable or relatively permanently placed.

The dishwasher 10 includes a housing 11, a liquid dispenser 12, and a number of brushing or wiping devices 13, which will be referred to below as brushes for convenience of description. The dishwasher 10 also may include a dryer 14. The top of the housing 11 may be closed by a top wall or cover 15 (shown in FIG. 1 partly broken away), if desired; and the bottom of the housing may be closed by a separate wall or cover (not shown). Depending on the place where the dishwasher would be used, e.g. in a sink or above or in a water collection tray, etc., the bottom cover may be eliminated, as water and removed food may drain directly from the dishwasher into the sink. Also, if spray out to the top of the housing 11 is minimal or substantially non-existent during washing operation, the cover 15 or part of it may be eliminated.

The liquid dispenser 12 may include, for example, the capability of dispensing water for washing a dish. The liquid dispenser may include a wash water dispenser 12*a* (FIG. 2) that dispenses water for washing the dishes and/or may include rinse water dispenser 12*b* to the wash water any excess other material from a dish. A soap or other dispenser may be used to add soap to the wash water dispenser 12*a*; and an appropriate dispenser may be used to add another ingredient to the rinse water dispenser 12*b*, examples being described below. One or both dispensers may include a disinfectant to help disinfect the dishes. The dryer 14 may include, for example, an air distributor to direct air flow toward a dish to blow water off the dish and/or to effect a drying function. The air may be scented to add a scent to the dishes, and the air may include a disinfectant to help disinfect the dishes.

The dishwasher 10 has an inlet or entry side 20 in which there is an inlet or entrance 21 for dishes, such as the illustrated dish 22, to enter the interior chamber 23 (sometimes referred to as the washing chamber or as the chamber) of the housing 11. The housing 11 also has an outlet or exit side 24 in which there is an outlet or exit opening 25 from the housing 11 allowing a dish, such as the dish 22, to exit the chamber 23 of the housing. The entrance 21 and exit 25 may be somewhat slot-like to provide space for dishes to pass therethrough while minimizing splashing to the outside of the dishwasher. Flexible flaps 21*f*, 25*f* may block some splashing out of liquid and food waste through the entrance 21 and exit 25.

In the embodiment of dishwasher illustrated in FIGS. 1A, 2 and 3 the dishwasher is in a horizontal orientation, e.g., the dishes are moved into and through the washing zone 23*w* in the chamber 23 along a generally horizontal path while the generally planer surfaces of the dish are generally horizontally oriented. In this orientation the slot-like entrance 21 and outlet 25 are generally horizontally arranged. This orientation minimizes the height requirement for the dishwasher and may make it more convenient for a user manually to hold or to grasp a dish. However, if desired, the brushes, fluid flows, inlet and outlet, etc. of the dishwasher may be generally vertical or are oriented in a direction that is between vertical and horizontal, e.g., as is illustrated schematically in FIG. 1B.

In FIG. 1B the dishwasher is in a generally vertical orientation to wash a dish in a generally vertical orientation, e.g., the major generally planer extent of the dish is in a generally vertical plane. This orientation tends to take advantage of gravity to facilitate the flow of particulates off the dish and the flow and dripping of washing fluid off the dish as it is being washed.

It is to be understood that orientations other than those shown or specifically described herein may be used for the dishwasher, the parts thereof, and the manner of use of the dishwasher.

As is shown in FIGS. 1-3, the brushes 13 are arranged in a pattern such that one or more brushes would face one side of a dish 22 and one or more brushes would face the opposite side of the dish so that the dish is at least in part supported by the brushes as the brushes wipe against the dish and the dish is moved through the chamber 23. The terms to wipe, to scrape, to brush, etc. are used generally equivalently herein. During use of the dishwasher 10, a dish 22 would be placed in the inlet or entrance 21, e.g., manually, and would be pushed in the direction of the arrow 26 also represents the travel path through the chamber 23 to the outlet or exit 25 from which the dish may be removed e.g., manually from the dishwasher.

The liquid dispenser 12*a* is relatively up stream along the travel path represented by the arrow 26 to direct liquid, such as water, soapy water or other liquid to the dish to facilitate washing it and/or to effect washing. The brushes 13 are rotated to wipe, brush, scrape, or the like against a surface of the dish 22 to effect a cleaning or washing function, for example, in conjunction with the liquid that has been dispensed by the liquid dispenser 12*a*. The liquid dispenser 12*b* applies a rinse liquid, such as, for example, water or some other liquid, to the dish to remove additional dirt and/or soapy water, etc. The dryer 14 directs a flow of air, for example, heated air or simply room ambient temperature air, to the dish to blow off excess water or other liquid and to effect a drying function. The heated air may be scented to add a fragrance to the dishes.

Also, if desired as is illustrated in FIG. 2, a soap dispenser 12*c* may be inject soap or detergent into the wash water line 12*a*. The soap dispenser 12*c* may be manually operated, e.g., using a manual dispenser bottle, or it may be a continuous flow supply of soap or detergent controlled by a suitable valve 12*d*. Other arrangements to provide soap or other ingredient to the water in the wash water line 12*a* may be used.

The brushes 13 tend to hold the dish 22 in an appropriate position as it is moved through the chamber 23 so that the liquid properly is dispensed to the dish and the brushes properly wipe the dish; and, additionally, so the drying air from the dryer 14 properly blows against the dish. The size of the dishwasher 10 may be such that a dish may be manually held at or near one edge as the dish is pushed manually into the dishwasher; and while the dish remains manually held by one hand of a user (person), the other hand may be used manually to grasp the other edge of the dish near the outlet or exit 25 to withdraw the dish from the dishwasher. For example, the total length of the travel path 27 may be on the order of approximately 3-8 inches (7.5-20 cm). These dimensions are exemplary only; the travel path may be shorter or longer depending on the intended uses and /or placement of the dishwasher, for example.

Thus, the dishwasher 10 may be used in a feed-through or flow-through manner, whereby a dish is inserted into the dishwasher at one side, is washed, (and if drying air is used, for example, is dried or at least partly dried) and is withdrawn from the other side. It will be appreciated that although manual use of the dishwasher is one example of such use, other mechanisms may be used mechanically to feed a dish into the dishwasher and/or to remove the dish. Moreover, although the dishwasher is illustrated and described herein in a feed-through or flow-through manner, it is possible that modifications may be made within the spirit and scope of the invention to allow the dish to be inserted into the dishwasher from one side and also to be withdrawn from that same side.

In the embodiment of dishwasher 10 illustrated in FIGS. 1-3 there are two sets of brushes 13, a top brush set 13*t* and a bottom brush set 13*b*, which, respectively, are oriented above and below the travel path 26 through the dishwasher. The two sets of brushes are oriented relative to the travel path to be in position to wipe or to brush against a dish as the dish is moved through the dishwasher in the course of being washed. The two sets of brushes may be positioned in sufficiently close relation to each other as to provide support and guidance for a dish as it is moved through the dishwasher. For example, the bottom set 13*b* may support the dish from below and the top set 13*t* may urge the dish toward the bottom set both to assure that both sets of brushes wipe against the dish as it is moved through the dishwasher and also to block the dish from moving or "flying" up toward the top of the dishwasher. In alternate embodiments one or the other of the top and bottom sets 13*t*, 13*b* of brushes may be eliminated, e.g., in the event only one side or face of the dish (or other object) is to be scraped or brushed.

An advantage of using two sets of brushes 13*t*, 13*b* is that they may tend to center the dish between the two sets so that both sets of brushes wipe against the dish with approximately the same wiping force. Also, additional support structure for the dish may be unnecessary, as adequate support may be provided by the brushes. By reducing the need for a further support, cost is reduced, weight is reduced to enhance portability, rigid parts against which a dish may be shoved causing chipping of the dish are avoided, and wiping forces are relatively uniform whereby each dish is wiped with approximately the same force. In the event that only one set of brushes is used, e.g., only the top set 13*t* or bottom set 13*b*, additional support or holding functions may be provided, if desired, to provide support for a dish as it is moved through the dishwasher.

An example of one brush 13*t*' in the top brush set 13*t* is described here as exemplary of the other brushes in the top and bottom brush sets 13*t*, 13*b*. The brush 13*t*' includes a brush element 40, a mounting shaft 41, a gear assembly 42 (also sometimes referred to as a transmission assembly 42). The brush element 40 may be made of bristles, sponge material, fabric material, or virtually any material suitable to provide a brushing action and function with respect to dishes 22. In the illustrated embodiment the brush element is donut-shape or annular shape, but the brush element 40 may be some other shape. A suitable mounting mechanism attaches the brush element 40 to the mounting shaft 41. The mounting shaft 41 may be turned/rotated to cause the brush element 40 to rotate to perform its wiping function against a dish 22, for example. The front or distal end of the mounting shaft 41 holds the brush element 40, and the back or mounting end of the mounting shaft 41 is supported in the gear assembly/transmission 42.

The gear assembly/transmission 42 includes a cylindrical support housing and gear assembly 43 and suitable bearings and the like for mechanically supporting the mounting shaft 41 with the brush element 40 on it and allowing a turning or rotating of the mounting shaft 41 and brush element 40 about the axis of the mounting shaft 41. Drive gear and drive shaft mechanism 44 provides mechanical rotational input to gear assembly/transmission 42, which in turn rotates the brush elements 40 via shafts 41. The support housing and gear assembly 43 is mounted on a support platform 45 by a suitable fasteners, welding, adhesive, or some other mechanism and the support platform 45 is mounted in the dishwasher housing 11, as by brackets or other suitable mounting arrangement. The support platform 45 may be supported on the drive shaft 46 by a sleeve support 45*a*. A motor 47 rotates the drive shaft 46 via the gear assembly 43; and the gear assembly 43 rotates the mounting shaft 41 to rotate brushes 13.

The support platform 45 is composed of a number of independently pivotable support platforms that in turn are rotatably mounted on the drive shaft 46 to allow each brush element 40 independently to float over or under a given dish. The brushes may be rotated by a helical gear arrangement, for example, that includes a helical gear in the support housing and gear assembly 43 that meshes with a corresponding helical gear that is mounted on the drive shaft 46. Alternatively a belt drive or other transmission may be used. During use torque or other applied force applied through the drive shaft 46, gear assembly 42 and mounting shaft 41 to the brushes tends to urge the brushes in respective rows toward each other so they would be urged against a dish or the like and/or such that the brushes 13*t* are urged toward the brushes 13*b*, and vice versa. If desired, springs may be used to urge the top and/or bottom brush elements toward the dishes and toward each other as the pivotable parts of the support platform 45 independently pivot. There is a separate drive gear and drive shaft mechanism 44 for each mounting shaft 41 and gear assembly/transmission 42, and each drive gear assembly 43 is mounted on drive shaft 46, which is turned by a motor 47. Therefore, the rotational input by the motor 47 rotates the mounting shafts 41 and brush elements 40. Other drive arrangements may be used to operate the brushes.

The several brushes in the upper brush set 13*t* are similar to the brush 13*t*' just described as are the brushes in the lower brush set 13*b*. However, the motor 47 is coupled by a gear mechanism 50 to the upper drive shaft 46 and the lower drive shaft 46*b* in such a way as to rotate the two drive shafts in opposite directions. Therefore, the brushes in the upper brush set 13*t* rotate in a direction opposite the direction of rotation of the brushes in the lower brush set 13*b*. When brushes in the two brush sets engage each other during rotation, e.g., when a dish is not separating them, they rotate approximately at the same speed, interengage with each other, tend to deform each other and/or to interengage each other to clean each other, and minimize the forceful interference that would be encountered if they were rotating in opposite directions and, thus, minimize the power requirement to rotate the brushes. Furthermore, since the brushes are rotating in opposite directions, the torque applied by the motor 47 to the upper drive shaft 46 and lower drive shaft 46*b* is in opposite directions and results in a tendency for the brushes and support platforms to tend to be urged and pivot in opposite directions, e.g., toward each other. For example, the upper drive shaft 46 and support platform 45 associated with it tend to be urged to rotate in a counter clockwise direction, whereas the brushes, support platform and lower drive shaft 46*b* tend to be urged to rotate in a clockwise direction.

As is illustrated in the drawings, there are two rows of brushes in the upper brush set 13*t* and similarly there are two rows of brushes in the lower brush set 13*b*. The two rows of brushes in the given brush set are at spaced apart locations along the direction 26 in the travel path. Spacing of the two rows is accomplished by using drive shafts 41 of appropriate lengths, e.g., whereby the brushes in one row are mounted on drive shafts of a relatively longer length and those in the other row are mounted on drive shafts of relatively shorter length. It will be appreciated that if desired there may be only one row of brushes in the upper and lower brush sets or there they be more than two.

In FIG. 3 a side view of the dishwasher 10 with the entire housing removed illustrates the relative positions of the brushes 13, including those brushes in the upper brush set 13*t* and those in the lower brush set 13*b*, to each other and to a dish 22, which has been inserted through the inlet 21. At the inlet 21 and outlet (or exit) 25 are splash guards formed of the pairs of flexible flaps 21*f*, 25*f*. The splash guards may be plastic, fabric, leather, or some other material. If desired, each of the upper and lower flaps 21*f*, 25*f* may be several pieces, whereby while one piece is pent or deflected out of the way by a dish 22, other pieces are beyond the side edges of the dish and are not deflected. The splash guards block at least some liquid that is being sprayed in the dishwasher 10 chamber 23 from splashing outside the dishwasher.

Water or other liquid is provided by the water dispensers 12*a*, 12*b* to wash and to rinse the dishes that are washed by the dishwasher 10. The water dispensers 12*a*, 12*b* include the respective water distribution systems 70, 71. The water distribution system 70 includes a pipe or tube 72 that is provided with wash water, e.g., soapy water, via a flow control 73. The water dispensers 12*a*, 12*b* may include openings 12*a*', 12*b*' for distributing water to a dish 22 being directed through the dishwasher chamber 23. Such water may be soapy water or may be some other fluid that provides a cleaning function; exemplary fluids and/or additives to the water include perfume, scent, disinfectant, wetting agent, etc. If desired, the water may be clear water without soap or it may be steam. Another fluid may be a particulate material, e.g., sand. The tube 12*a* includes a upper and lower portions, either or both of which distribute water toward a dish. The distributing openings 12*a*', 12*b*' may be nozzles coupled to the tube or some other mechanism to distribute water toward the dish. If suitable water pressure is provided by the flow control 73 the water may be directed to the dish as sprays, jets or streams to tend to wash food off the dish and to assist the brushes 13 in cleaning the dish. The spray may be augmented by mechanical devices to clean a dish, e.g., by brushes, straps, etc. The water may soften, melt, fluidize food or other material on a dish so the brushes would be able easily to remove such material from the dish. If the water spray (or spray of other fluid, e.g., steam, that is directed to the dish) is of adequate pressure, force, quantity, temperature, and/or cleaning capability, e.g., a biodegradable chemical wash, the brushes 13 may be unnecessary, thus allowing the dishwasher to be a brushless dishwasher. A connection 74 to the flow control 73 may be provided to a water tap, water faucet, pipe or some other supply of water, and a soap reservoir 12*c* may be provided in the flow control. Soap may be provided in the reservoir and picked up by the water flowing through the flow control 73 on its way to the tube 72.

The water spray distribution system 71 is similar to the system 70, and the parts thereof are labeled by the same reference numerals, but with a prime indication with each reference numeral. The water in the water spray distribution system 71 may be clear water used to rinse soap and any excess food particles from a dish and may include another additive provided at a reservoir 12*c*', e.g., wetting agent, perfume, disinfectant, etc.

A dryer 14 can be seen in FIGS. 2 and 3. The dryer 14 is coupled to two air-flow pipes 81*t*, 81*b* and includes a housing 82 containing a fan 83 and, if desired, a heater 84. The dryer 80 also has an air inlet 85. The dryer 80 receives air through the inlet 85, and blows the air by the fan 83 through the pipes 81*t*, 81*b*, which have air outlets 86 to direct, e.g., to blow, blow flow air toward a dish to dry the dish. If desired, the heater 84 may be used to heat the air to enhance the drying function.

Suitable electrical connections and controls may be provided, as is illustrated at 90. The controls 90 includes a connection 91 to a source of electrical power, and includes a connection 92 to various electrical parts of the dishwasher 10, such as, for example, to the motor 47, to pumps 93, 93' in the flow controls 73, 73', if used, in the flow controls 70, 71' (the pumps are schematically illustrated at 93, 93'), and to the dryer 14. If desired, the controls and electrical connection and controls 90 may include a transformer or the like to provide relatively low voltage to the several electrical parts of the dishwasher 10 and/or may include a portable power supply, e.g., a battery.

If desired, one or more electrical parts of the dishwasher 10, such as the motor 47, flow control 73, 73', and/or dryer 14 may be replaced by an hydraulic power system, whereby flow of water through the flow controls 73, 73', such as from a water faucet, household pipe, etc., may provide power to rotate the motor 47, to provide fluid flow in the water spray distribution systems 70, 71 and/or to turn the fan 83 of the dryer 80.

Although water distribution systems 12*a*, 12*b* are shown separately from the brushes 13, they may be included with or within the brushes. As but one example, the shafts 41 may be hollow to conduct water to the brushes from which the water is provided to wash a dish.

Also, due to the relatively small, compact size and shape of the dishwasher 10, it may be easily portable, positionable on a counter top, built into a cabinet, positioned in a sink or tub, used on a boat, aircraft, motorhome, etc.

Figure 4:
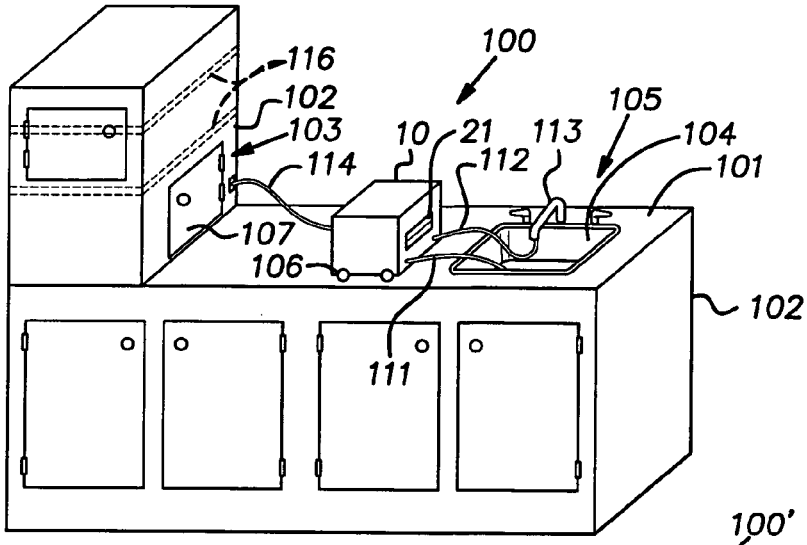
FIG. 4 is a schematic illustration of a dishwasher and cabinet arrangement in which the dishwasher may be stored in a cabinet approximately at counter top level.

Briefly referring to FIG. 4, a built-in arrangement 100 for a dishwasher 10 is shown. The arrangement 100 includes a counter 101 on which the dishwasher 10 may be placed for use, cabinet 102 in which the dishwasher 10 may be stored in an area 103, and a sink 104 and water supply 105 to drain water from the dishwasher and to supply water to the dishwasher, respectively. The dishwasher 10 may be mounted on rollers, wheels or the like 106 or may be mounted on a slide bracket (not shown) to allow the dishwasher to roll on the counter 101 or to be supported on a slide bracket between locations stored in the area 103 in the cabinet 102 or out on the counter 101 for use. A spring may be used to urge the dishwasher 10 out from a stored position in the area 103 and a latch and/or door 107 may be used to retain the dishwasher within the cabinet area 103. If desired, as is shown in FIG. 8B the dishwasher 10 may be located beneath the counter 101, and it may "pop up" for use. In such case, if desired, the top of the dishwasher 10 may have a piece of counter material on it to fill in an opening in the counter that provides access to the stored dishwasher in the area 103 of the cabinet 102.

In using the dishwasher 10 in the arrangement 100, a drain hose 111 may be coupled between a drain (not shown) in the dishwasher bottom wall and the sink 104, for example, and a water supply hose 112 may be coupled from the water supply 105 spout 113 to the water inlet 74 of the dishwasher (FIG. 2). If water (hydraulic) power is used to rotate the brushes 13 and/or to operate a fan in the heater or dryer 14 (FIG. 2), then no further connections may be needed to operate the dishwasher 10. If electrical power is needed, then an electrical connection from a conventional electrical outlet or the like may be provided by a suitable electrical cord 114, for example. Water is supplied to the dishwasher by the water supply hose 112; and water is drained from the dishwasher by the drain hose 111. Dishes may be passed through the dishwasher or into the dishwasher and withdrawn therefrom for washing. Since the dishwasher is directly on the counter 101 adjacent the sink 104 and cabinetry 102, a user may dump excess food from a dish into the sink, pass the dish into and/or through the dishwasher in which it may be washed and dried, and stack the dish directly into its place in the cabinetry 101 on shelves 116, for example, that are schematically illustrated in FIG. 4.

Figure 5:
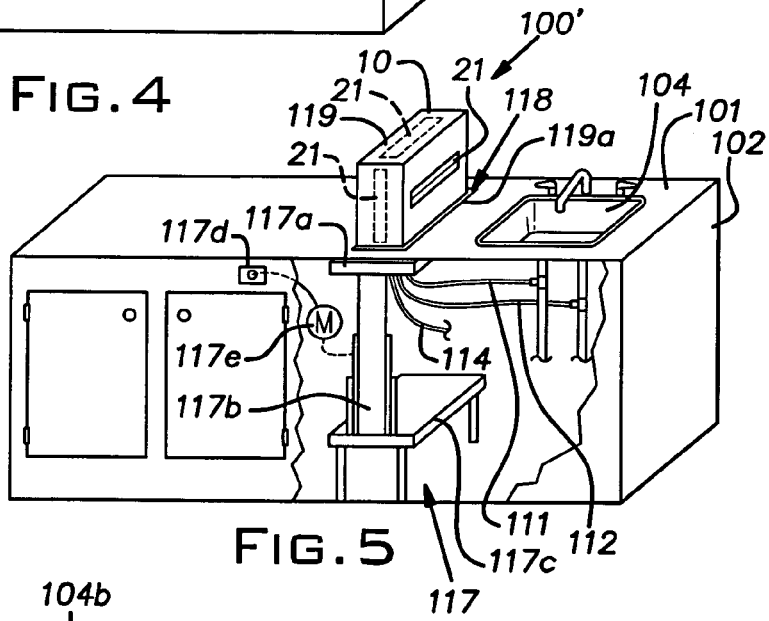
FIGS. 5 and 6 are schematic illustrations of a dishwasher as part of a double sink or in between a pair of sinks.

FIG. 5 shows another built-in arrangement 100' for a dishwasher 10, for example. The dishwasher 10 is shown at the counter top 101 of the cabinet 102 connected to a source of electrical power at 114 and to a drain and to a water supply via hoses, pipes, etc. 111,112. Such fluid connections to water and drain may be beneath the counter in a substantially permanently connection or above the counter by hoses to the water faucet supply and sink drain. The dishwasher 10 is supported from a storage and support structure 117, which includes a support platform 117*a*, telescoping support 117*b*, e.g., one or a number of concentric tubes, scissors jack, or the like for raising or lowering the dishwasher above or to the support platform 117*a*, and a mount 117*c*, e.g., legs or attachments to the cabinet 102. An opening or cutout 118 in the counter top 101 allows the dishwasher 10 to be raised to a level as shown in FIG. 5 for use with the dishwasher approximately at counter level; and also allows the dishwasher 10 to be lowered by the support structure, e.g., withdrawing of the telescoping structure or scissors jack into the interior of the cabinet 102 for support on the support platform 117*a*. On the top of the dishwasher is a material 119 that may be substantially the same as that of which the counter top 101 is made, and the shape of that material is such as to fit into and substantially fill the opening 118 so that the counter top 101 appears to be substantially integral and smooth, thus tending to hide (camouflage) the dishwasher storage beneath the counter top. If desired, a seal 119*a* may be provided between the material 119 and the counter top 101 at the opening 118 to impede the flow of fluid or other material into the opening 118 when the dishwasher is in stored position. The seal 119*a* also may seal against the sides of the dishwasher 10 housing 11 when the dishwasher is in use position, e.g., as is illustrated in FIG. 5, to block flow of water and/or other material into the opening 118.

A control switch 117*d* may operate the unit 117*b* by energizing a motor 117*e* that is connected to the telescoping structure 117*b* or scissors jack, etc. to raise and to lower the dishwasher 10. Operating the switch 117*d* causes the dishwasher 10 to "pop up" out of the counter top to be available for washing dishes. The operating of the control switch 117*d* also operates the unit 117*b* to withdraw the dishwasher into the counter.

Figure 6:
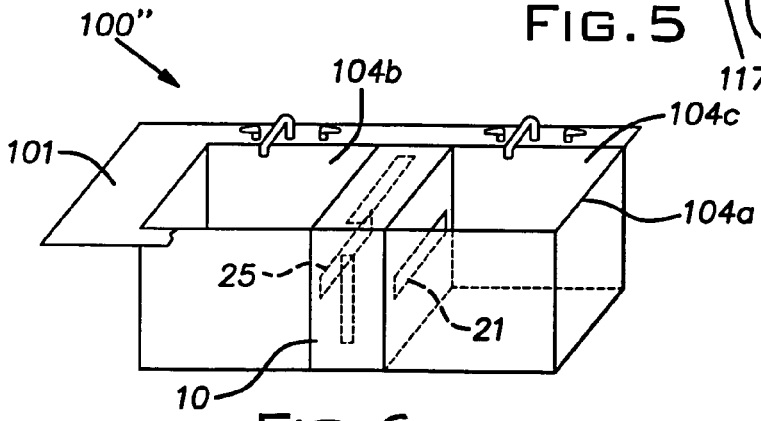

FIG. 6 is a schematic illustration of another arrangement 100" of a dishwasher 10 as part of a double sink 104*a*, e.g., between the sink bowls 104*b*, 104*c* thereof, or in between a pair of sink bowls 104*b*, 104*c* of separate sinks. The space between two sinks or between the bowls of a double sink sometimes is relatively wasted space; and such space can be used efficiently by strategically placing the dishwasher there. The side walls of respective sink bowls, whether of a double sink or of two sinks, may have slot-like openings that align with the dishwasher entrance 21 and exit 25 below the level of the top of the sinks; and a dish can be passed from one sink through the dishwasher toward the other sink and removed via the other sink. The top of the dishwasher may be beneath the counter top 101, which would be in the space between the two sinks; or the top of the dishwasher may be such counter top 101 and be able to rise as the dishwasher is telescoped to increase the height of the entrance and exit to wash glasses, cups, pots, etc., as was described above. Suitable seals may be provided so water does not drip in the area between the sinks. Also, if desired, the dishwasher 10 may be arranged in a manner similar to that shown in FIG. 5, whereby the dishwasher may "rise" up from beneath the counter 101 and/or tops of the sinks to be available to wash dishes while being conveniently placed at the sink area.

Embodiments of dishwasher that are described below have a top entrance/exit, e.g., as in FIGS. 1A, 2 and 3, and other embodiments have an end entrance/exit, e.g., as in FIG. 1B. The dishwasher 10 shown between sinks 104*b*, 104*c* in FIGS. 5 and 6 may use an opening 21*a* in the top as an entrance/exit or an opening 21*b* in an end wall of the dishwasher as entrance/exit.

Referring briefly to FIGS. 7-8, a dishwasher 10''' is shown with an adjustable housing 11' that allows the inlet 21 and, if used, the outlet 25 to be increased in size, e.g., height, in case of a large, e.g., thick, dish, pot or pan, or a drinking glass is to be washed. The dishwasher 10''' includes adjustable couplings 200-203 for the several fluid systems, e.g., air flow for drying, water distribution for washing and/or rinsing, etc., and adjustable mechanical coupling for operating brushes, if used. The housing 11' has two parts 11*a*, 11*b* that can be placed in engagement with each other, as is illustrated in FIG. 7, or can be separated, as is illustrated in FIG. 8, respectively, to minimize or to increase the size of the inlet 21. The coupling 203 for the drying air flow and the coupling 201 for respective liquid, e.g., water, flow systems, allow the housing parts to be moved away or toward each other while maintaining the integrity of the respective fluid systems avoiding leaks. The mechanical coupling 202 may be a gear arrangement or a flexible drive that allows motive force for the brushes to be transmitted to them from the motor as the housing parts are moved toward or away from each other.

Figure 22:
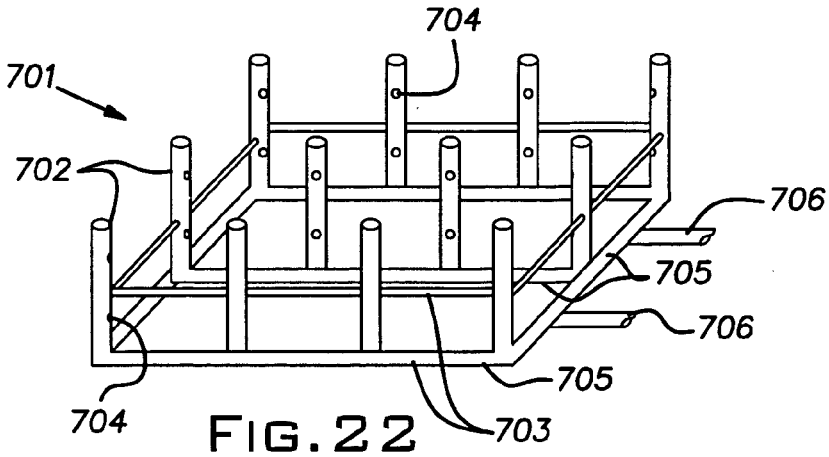
FIG. 22 is a schematic illustration of a rack for a dishwasher, the rack having flow passages therein for steam and/or for washing liquid.

As seen in FIGS. 15 and 22, a tray may be used to carry dishes or the like into and out of the dishwasher chamber 23 and to retain the dish or the like in the washing zone 23*w*. A lazy susan type of device may be used to hold the dish or the like and to carry it into and out of the washing zone of the dishwasher.

With the above in mind, then, it will be appreciated that the present invention provides for a space efficient dishwasher that operates efficiently to wash dishes of different sizes.

Referring to FIG. 8, the dishwasher 10''' housing 11' has upper and lower portions 11*a*, 11*b* that can be moved toward or away from each other, e.g., telescoped, using a motive system 210. The motive system 210 includes a crank mechanism 211 that can be operated by rotating a crank 212 to move the housing parts toward or away from each other. Other types of motive systems may be used.

The illustrated motive system 210 includes a pair of slide bars 213, 214 that are attached to the upper housing part 11*a* by straps 215 and suitable fasteners, e.g., screws, rivets or the like 216. The slide bars also are mounted to slide relative to the bottom housing part 11*b* using slide guiding straps 217, which are attached to the lower housing part 11*b* by suitable fasteners. The slide bars 213, 214 have teeth 220, such as gear teeth, and the crank mechanism 212 includes a pair of rotatable gears 221, 222 that have corresponding teeth 223, 224 to mesh with each other and with the teeth 220 generally as is illustrated in FIG. 8. The gears 221, 222 are attached to a side wall 225 of the lower housing part 11*b*. The crank 212 may be turned manually (or by using a motor or the like), to rotate the gear 221. The rotating gear 221 turns the gear 222. Rotating of the two gears causes the slide bars 213, 214 to move upward or downward, depending on the direction of rotation of the crank 212. As the crank is rotated in a clockwise direction shown in FIG. 16C, for example, the upper housing part 11*a* is moved upward or away from the lower housing part 11*b*. The weight of the upper housing part and other portions of the dishwasher that may be secured thereto within the dishwasher chamber 23, for example, in effect would be aligned in proper position using the slide bars 213, 214, on the one hand, while the weight of the upper portion of the dishwasher may be borne or carried by the gears 221, 222 and the axles 231 on which they are mounted to the lower housing part 11*b*.

A motive system 210 may be located at each side wall 225 of the dishwasher 10''', and each may be independently operated. Such operation would be in unison so that both sides of the dishwasher tend to be lifted or lowered simultaneously approximately at the same rate to avoid distorting the slide bars and/or other parts of the dishwasher. Also, if desired, a mechanical connection may be provided between the motive systems 210 at both sides of the dishwasher 10''' to synchronize lifting or lowering (or separating and joining) one housing part 11*a*, 11*b* relative to the other. Furthermore, if desired, electrical, hydraulic, or other mechanisms may be used to enlarge the inlet and outlet openings of the dishwasher 10'''

A flexible splash guard 233 that is schematically illustrated at a cutout of the dishwasher in FIG. 8 tends to block splashing of liquid out through the gap 235 between the upper and lower housing parts 11*a*, 11*b* when they are separated from each other. The splash guard 233 at each side wall of the dishwasher 10''' may be of a suitable height so that it covers the gap 235, on the one hand, but does not buckle or hit the bottom of the dishwasher when the dishwasher is in its minimal height mode. Suitable other splash guards may be provided for the dishwasher 10'''. The splash guards at the inlet 21 and outlet 25 may be of suitable height, strength, and flexibility to confine liquid in the dishwasher so it does not spray out, on the one hand, and to be adequately flexible to allow a dish to be inserted into and removed from the dishwasher, as was described above.

Figure 9:
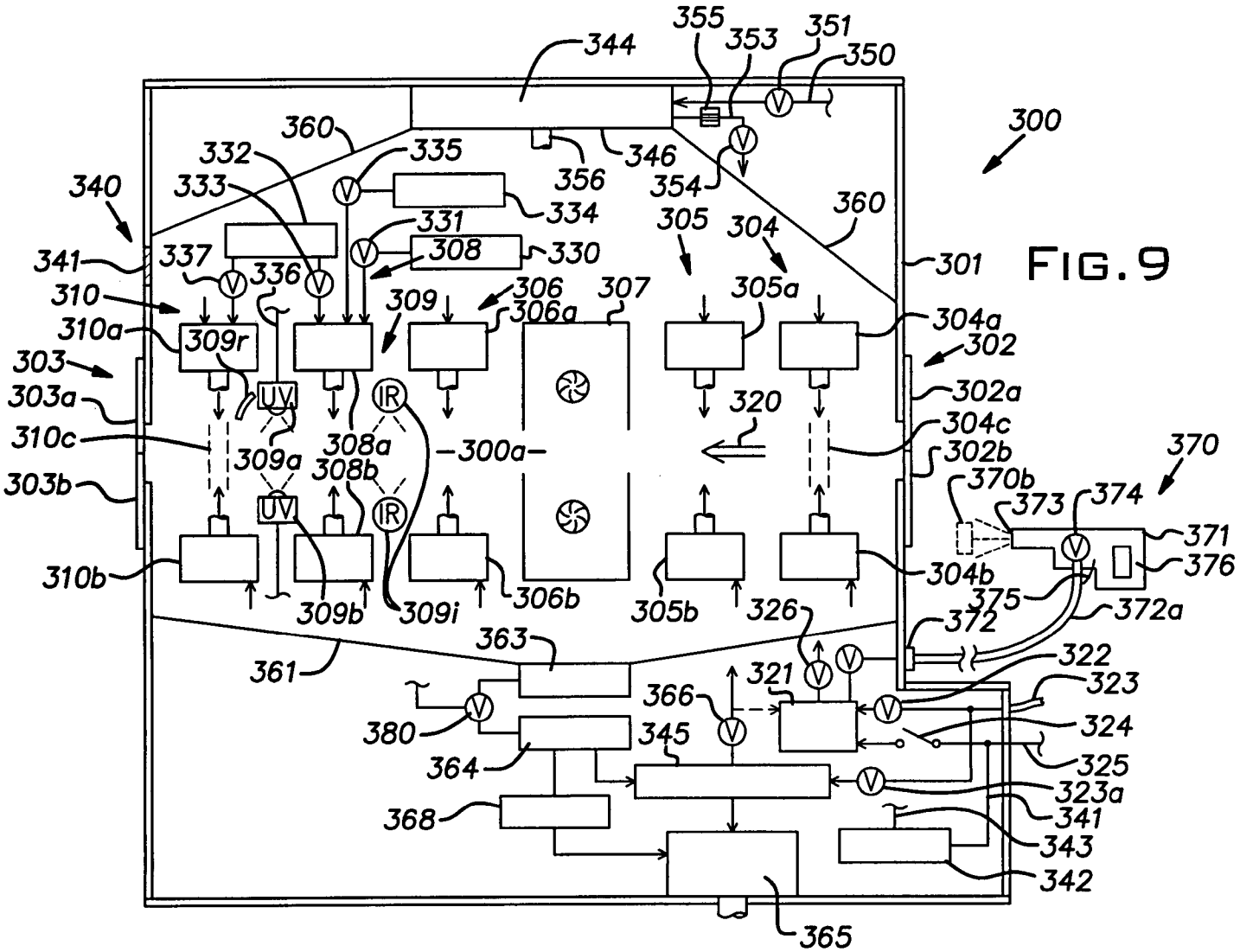
FIG. 9 is a schematic illustration of another embodiment of dishwasher in accordance with the present invention.

Turning to FIG. 9, a dishwasher 300 is illustrated schematically. Features of the dishwashers 10,10', 10'' and 10''' may be used in the dishwasher 300; and vice-versa. The dishwasher 300 may include a number of the features, components and functions of the above-described dishwashers 10, such as, for example, to provide a dishwasher housing 301, inlet 302 for dishes or other objects intended to be washed, and outlet 303 to remove the washed item. The dishwasher 300 includes a wash water zone 304, steam zones 305, 306, brush zone 307, rinse water zone 308, ultra-violet light zone 309, and drying air zone 310. Flow pipes, nozzles, valves, and fluid distributing mechanisms for the water, steam and air at the above-mentioned zones, for example, maybe of the type described above with respect to FIGS. 1-8 or may be some other type, as may be desired to obtain functions of washing, cleaning and/or drying dishes. In the wash water zone 304 water spray outlets, 304*a*, 304*b* may be used to direct water spray, water jets, or the like toward a dish. The water spray may be relatively high intensity or flow rate to tend to dislodge particles while also providing a washing effect. The water may include soap, detergent, or other ingredient(s) to facilitate the washing function. The water may be heated to facilitate the washing function.

A dish may be moved along the travel path 320 to be washed and dried. The several water, steam, brush, air and ultraviolet zones may include two respective parts, one above and one below the travel path, respectively, as is illustrated, or may include only one part either above or below the travel path. If the dishwasher 300 were oriented, as is illustrated in FIG. 1B, whereby the dish would be in a generally vertical plane during washing, then those respective parts may be laterally spaced apart in a horizontal direction as to be on opposite sides of the travel path.

The devices for delivering, e.g., dispensing, spraying, directing, etc., fluid toward a dish, such as the zones 304, 305, 306, 308 and 310, may include one or more nozzles, a pipe with openings, a spinning nozzle arrangement, or some other suitable fluid outlet or group of outlets to direct fluid toward a dish in the travel path 320. If desired, a given flow path may share respective fluids; e.g., water, air and/or steam may be directed via the same nozzles or other outlets toward a dish at respective times during the washing and/or drying of the dish.

At the first steam zone 305 respective steam outlets or sprayers 305*a*, 305*b* provide a flow or spray of steam toward a dish in the travel path 320. The steam tends to clean the dish, while heating and moisturizing material that may be adhered to the dish, such as, for example, gravy, egg, or other material. The heated material tends to become fluidic and relatively easily can flow off the dish, be brushed off the dish, etc. A steam generator 321 provides steam to the steam outlets 305*a*, 305*b*. The steam generator 321 may be coupled by a valve 322 to a supply of water 323 and may be coupled by a switch 324 to a source of electric power 325. When energized, the steam generator 321 may heat the water provided to it via the valve 322 to produce steam that is supplied via a valve 326 to the steam outlets 305*a*, 305*b*.

As is seen in FIG. 9, water from the water outlets 304*a*, 304*b* (or from one of them) provides a curtain 304*c* of water between the inlet 302 of the dishwasher and the steam zone 305. The water curtain 304*c* tends to block steam from the steam zone 305 from reaching the inlet 302 in a manner similar to the way air curtains are used at the entrance to buildings to retain heat in the building and to block cold from entering a building in a cold climate condition. The water also washes a dish.

The air flow from the air outlets 310*a*, 310*b* also may provide an air curtain 310*c* that tends to block exiting of steam and/or water through the dish outlet 303.

In the brush zone 307 a number of brushes, two of which are shown at 307*a*, 307*b*, such as, for example, the brushes described above with respect to the dishwasher(s) illustrated in FIGS. 1-3 are used to brush against or rub against a dish in the travel path 320. The brushes tend to scrub particular material, fluid material, etc., from the dish. The brushes may be positioned both above and below the travel path or only at one of those locations.

The steam outlets 306*a*, 306*b* at the second steam zone 306 direct additional steam to a dish in the travel path 320. The additional steam may be used for cleaning and for disinfecting. The second steam zone 306 provides steam that further causes caked or dried material that is on the dish to become fluidic to facilitate washing it from the dish after the dish has been brushed of other particulate matter in the brush zone 307. If desired, the second steam zone 306 may be omitted or may be used instead of the first steam zone 305. Steam for the steam outlets 306*a*, 306*b* may be provided by the steam generator 321 in the manner described above. The delivery of steam to the respective steam zones 305, 306 may be selectively controlled by the user of the dishwasher 300, for example, by selectively operating the switch 324 and/or one or both valves 322, 326.

In the rinse water zone 308 rinse water outlets 308*a*, 308*b* direct water to the dish for conventional rinsing purposes. The rinse water may wash off any material that has become fluidic on account of the steam provided at the steam zone 306. The rinse water may rinse off the remaining wash water from the wash zone 304, detergent and remaining particulate matter. The water supplied the rinse water outlets 308*a*, 308*b* may include a wetting agent to enhance the rinsing function. A source of wetting agent is shown at 330. Delivery of wetting agent to the rinse water may be controlled by a valve 331. If desired, a coating can be sprayed onto the dish by the one of the liquid or steam lines and outlets to apply a glaze type of appearance to the dish; such a glaze material may be like a wetting agent or some other agent that evaporates relatively quickly but leaves the dish shiny and bright. A supply 332 of perfume or fragrance may be added to the rinse water via a valve 333. The perfume or fragrance may be used to make the washed dishes smell clean. A source of disinfectant 334 may be provided. The disinfectant may be a fluid that is provided a valve 335 to the rinse water outlets 308*a*, 308*b* to provide disinfecting function as the dishes are rinsed.

Ultra-violet light zone 309 includes ultra-violet light sources 309*a*, 309*b*, e.g., sources of ultra-violet electromagnetic energy, with associated lenses, light directors, light shields, etc.; ultra-violet light is directed toward the dishes to tend to kill bacteria and otherwise to disinfect the dishes. The ultra-violet light may be provided from above, below or both above and below the travel path 320, as may be desired. Reflectors 309*r* may be provided to reflect ultra-violet light from one or more ultra-violet light sources, as may be desired. For example, instead of several ultra-violet light sources 309*a*, 309*b*, a single ultra-violet light source may be used and one or more reflectors may direct the ultra-violet light to desired locations in the dishwasher. Electric power to operate the ultra-violet sources may be provided by electrical connections 336, e.g., coupled to electrical input 325. The intensity of the ultra-violet light and the positioning of the ultra-violet light source, may be set to a level and location to carry out the desired disinfecting function, e.g., bacteria killing, germ killing, etc.

The UV sources 309*a*, 309*b* may be strategically located in the interior chamber 300*a* of the dishwasher 300 to provide ultra-violet illumination incident on the dish throughout part or substantially all of the travel path 320 of the dish and the dishwasher. The ultra-violet light sources 309*a*, 309*b* may be located in the manner illustrated in FIG. 9 or may be located somewhat more laterally, e.g., at the side near the outlet 303 to disinfect prior to removing a dish from the dishwasher chamber 300*a*. More than two ultra-violet light sources may be strategically located in the dishwasher chamber 300*a* for disinfecting a dish and, if desired, the dishwasher itself.

At the drying air zone 310 drying air from outlets 310*a*, 310*b* is provided to blow against a dish that has been washed in the dishwasher 300. The drying air may blow any remaining liquid from the dish, such as, for example, rinse water or remaining water that has condensed from the steam and/or has been provided by the wash water. The air flow also may tend to cause evaporation of any remaining moisture on the dish. If desired, perfume or fragrance from the perfume source 332 may be provided via valve 337 to the drying air to add a fragrance or good smell, e.g., a fresh smell or a clean smell, to the dish.

It will be appreciated that the several parts of the dishwasher, such as the wash water outlets, steam outlets, brushes, rinse water outlets, ultra-violet light sources, and drying air outlets may be provided both above and below the travel path 320 or may be provided only either above or below, as may be desired, depending on use of the dishwasher, ultimate versatility of the dishwasher, etc. For example, if a dishwasher is to wash only a certain size dish that always is facing with the "eating surface" down, and the bottom surface of the dish always is facing up, and prior to insertion in the dishwasher, the dishes ordinarily would not be stacked, then a number of the described parts of the dishwasher may be located only below the travel path and not necessarily be needed above the travel path. The drying air, though, may be located both above and below the travel path in such case, for example, so as to dry both the top and bottom surfaces of the dish; although the primary washing function would be against the eating surface, spray may reach the other surface of the dish. This is but one example of many modifications that may be made to the dishwasher 300 while still being within the spirit and scope of the present invention.

Also, as is illustrated schematically in FIG. 9 arrows indicate respective inlets of water, air or steam to the water, steam and outlets, e.g., at 304*a*, 304*b*, 305*a*, 305*b*, 306*a*, 306*b*, 308*a*, 308*b*. If desired, steam may be provided to the wash water outlets 304*a*, 304*b* to increase the temperature of the wash water and also to provide the functions of the steam as described above with respect to the steam zone 305.

At the dish inlet 302 resilient flaps 302*a*, 302*b* may be provided as a spray guard and/or to rub against a dish as the dish is inserted into the travel path 320 inside the dishwasher housing 301. The flaps 302*a*, 302*b* also may provide a sealing function to block heat and water from spraying out or coming out of the dishwasher as the dish is inserted. Similar flaps 303*a*, 303*b* may be provided at the dish outlet 303 also to tend to prevent air, water and steam from exiting the dishwasher. The flaps 302*a*, 302*b*, 303*a*, 303*b* may be relatively light impervious or at least impervious to ultra-violet light to tend to block ultra-violet light from exiting the interior of the dishwasher. The flaps may have a reflector or a reflective surface to reflect ultra-violet light toward the interior of the dishwasher.

A vent 340 may be provided in a wall of the dishwasher to allow outflow of air from the dishwasher, if desired. The vent 340 may include light baffles 341 that may be light absorbing and provide a somewhat tortuous air flow path while blocking light transmission through the vent thereby to prevent ultra-violet light from exiting the dishwasher through the vent 340.

The various components and parts illustrated in the drawings may be arranged in different configuration. For example, although the dishwasher 300 of FIG. 9 shows a horizontal travel path to wash a dish traveling through the dishwasher in a generally horizontal plane, the dishwasher may be of a configuration like that in FIG. 1B, whereby the dish would be in a generally vertical plane. If desired, the dishwasher may be arranged like that illustrated in FIG. 10, whereby the travel path is diagonally through the dishwasher housing. The arrangement of the various parts shown in FIG. 9, for example, may be modified for different configurations to provide for various travel paths through the dishwasher and/or space for the respective components, as needed. For example, various components of the dishwasher may be stacked, spread out, or otherwise arranged while still being able to carry out the desired functions to wash and to dry dishes, etc.

It will be appreciated that all or only some of the components illustrated in the dishwasher 300 of FIG. 9 may be used to wash a dish. For example, if a dish is not very dirty, only steam or only wash water may be needed to clean the dish. If a dish is quite dirty with caked or dried material on the dish, then more than one, or even all of the components of the dishwasher of FIG. 9 may be used to clean the dish. Still further, if desired, the dishwasher may be used to heat dishes for use in serving a hot meal; in such case only the heating mechanism, e.g., hot air from the dryer (FIG. 2) and air zone 310 may be used or infrared light (electromagnetic energy) from an infrared source 309*i* may be used.

The dishwashers 10, 300 may be of a modular construction. For example, the cabinet or housing 11 may be made with mounts for mounting therein one or more of the several components described herein, e.g., the air flows, the wash water, the rinse water, a detergent or soap supply, brushes, ultra-violet light, infrared light, etc. Mechanical connections may be provided to mount such components in the housing and to provide for external connections to electrical power, water supply, drain, etc. Thus, the dishwasher 10, 300 may be provided as a base system with no or with less than all the components that are disclosed herein; and one or more additional components can be added or removed, as desired.

Electrical power to the dishwasher may be provided at an electrical connection 325. The connection 325 may be an electric plug that can be plugged into a conventional 100 volts, 120 volts, 220 volts, etc., electrical outlet to receive suitable AC electrical power inlet. The electrical connection 325 may be a pre-wired electrical connection to existing electrical service in a house, motor vehicle, aircraft, boat, apartment, etc. Moreover, the electrical supply to the dishwasher may be provided by a suitable battery source, which enhances the portability of the dishwasher.

The dishwasher 300 includes a connection 341 to electrical circuitry 342 that is coupled to receive electrical input from the electrical connection 341. The electrical circuitry 342 may include a transformer to provide suitable voltage and current characteristics for operating various parts of the dishwasher. The electrical circuitry 342 also may include a number of controls to control the various valves, brush operating motors, ultra-violet light sources, fans, the steam generator 321, etc., as may be desired. The controls may be on-off controls, power level controls, frequency controls, etc., as may be desired. Connection of the electrical circuitry 342 to the various portions of the dishwasher, such as those described above, is shown schematically at 343.

To enhance power efficiency and power conservation, the dishwasher 300 may include one or more heat exchangers to heat the wash water, dish water and/or drying air, for example. Two heat exchangers are shown, respectively at 344, 345. The heat exchangers may be conventional heat exchangers that provide two separate fluid paths and a heat exchange wall or medium between those paths. For example, the heat exchanger 344 is located at the top area of the dishwasher and has a heat exchange wall 346 that is exposed to the interior 300*a* of the dishwasher. Steam and/or warm air may tend to rise and come into contact with the heat exchange wall 346. Within the interior of the heat exchanger 344 water flow may be provided via a connection 350 and valve 351 from the source of water 323 that is supplied to the dishwasher. The source of water 323 may be from a water faucet outlet, maybe connected by appropriate plumbing fixtures to a pipe, such as a pipe in a house for example, or may be provided from some other reservoir supplying water to the dishwasher. The water provided to the heat exchanger 344 via the valve 351 is heated by thermal conduction through the wall 346, and the heated water is provided via a heat exchanger outlet 353 and valve 354 for use in the wash water and/or rinse water portions of the dishwasher.

A pressurizer 355 may be used at one or both water zones 304, 308 to pressurize water so that pressurized water is sprayed from nozzles or the like at those zones to increase flow rate and/or force of the water impinging on a dish to enhance the washing and/or rinsing. The pressurizer 355 may be a pump, a flexible bladder that applies pressure to water therein or in a separate chamber, a piston that applies pressure to water in a reservoir, e.g., in a tank, or some other device.

If desired, air supplied to the dishwasher may be provided via the heat exchanger 344 to heat the air that is then provided via an air outlet 356 to the drying air zone 310. The air and water sections of the heat exchanger 344 may be separated from each other, but nevertheless both may have exposure to the heat exchange wall 346.

As is illustrated schematically in FIG. 9, the top area of the interior of the dishwasher housing 310 has a sloped wall 360 that tends to direct rising heated air and/or steam toward the heat exchange surface 346 of the heat exchanger 344.

A bottom wall 361 of the dishwasher at the bottom of the washing chamber area 347 also may be sloped in such a way as to guide liquid and waste carried by the liquid to a filter 363. The filter may include a removal screen or the like that can be taken from the dishwasher, cleaned, and reinstalled in the dishwasher. The filter leads to a sump 364, which in turn directs liquid either to the further heat exchanger 345 or directly to a storage drain device 365. The second heat exchanger 345 allows an exchange of heat from the waste water to the inlet water provided from the water inlet 323 via a valve 323*a*. The heat exchanger provides for a preheating of the inlet water prior to delivery via a valve 366 to the wash water and/or rinse water zones, to the steam generator 321, and/or to the heat exchanger 344. It will be appreciated that there are various combinations and permutations for using heat exchangers in the dishwasher to enhance the efficiency of the steam generating functions, washing functions, rinsing functions, etc. while minimizing power requirements. Thus, it will be appreciated that the water may be supplied to the wash water zone 304, rinse zone 308, the steam in the steam zones 305, 306, and the air provided to the drying air zone 310 via one or more heat exchangers, etc. A garbage disposal 368 may be provided at the area of the filter, sump, drain, etc., to convert waste food so it will go down the drain.

Although there are seven zones illustrated in the dishwasher 300 in FIG. 9, e.g., zones 304-310, one or more of those zones may be removed and/or the location of a given zone relative to the other zones may be changed. For example, if suitable cleaning is effected by steam without the need for brushes or water, then the brush zone 307 and water zones may be eliminated. As another example, the steam zones 305, 306 and the rinse water zone 308 may be eliminated if wash water and brushing are satisfactory to wash a dish without rinsing. The ultra-violet zone 309 may be unnecessary if there is no need to disinfect using ultra-violet electromagnetic energy.

A prewash device 370 also may be provided. The prewash device may include a hand held sprayer 371, e.g., analogous to a spray wand or spray gun type device, that has an inlet coupling 372 to the steam generator 321 and has a spray outlet 373 to spray fluid against dishes to provide a prewash. The prewash device 370 may spray steam, water, other liquid, and/or various combinations thereof. The device 371 may have a valve 374 that is operated by a trigger 375, such as a finger operated trigger, which manually opens and closes the valve 374 or operates the valve 374 via an electrical connection, e.g., via a solenoid or some other electrical fluidic connection to the valve 374. The valve 374 controls the flow of steam from the coupling 372 to the outlet 373. The handle 376 facilitates manual holding or grasping of the device 370 conveniently to spray steam against the surface of a dish and the relationship of the handle 376, shape of the device 371 and shape and positioning of the trigger, as well as the outlet 373 and coupling 372 may be of ergonomic configuration for safe, efficient operation and use. The prewash device 370 may be used preliminarily to wash a dish prior to placing the dish in the dishwasher delivering it along the travel path 320 to wash the dish in the dishwasher. The length of the coupling 372 may be selected, as desired, for a suitable storage of the prewashed device 371 when not used and for convenient use of the device. A valve 377 in the coupling 372 flow line 372*a* may be selectively operated to turn on or off the flow of steam to the prewash device 370. The coupling 372 may be a suitable quick connect/disconnect device of conventional design suitable to connect and to disconnect a steam line. The prewash device 370 in addition to providing steam or in place of providing steam may include a brush 370*b*. The brush may be fixed or it may be of a type that rotates or agitates freely or it may rotate or agitate under the motive force provided by water flow. A motor may be used to rotate the brushes. The brush may be used to help remove dirt and debris from the dish.

A word regarding the steam used in the dishwasher 300, such steam may be relatively low pressure steam that has suitable flow rate to direct the steam to the surface of a dish to effect a cleaning function. The temperature and flow of the steam may be suitable to cause dried material on a dish to become fluidic, and the pressure may be selected either only to effect that fluidizing function or also to effect a tendency to cause a flowing of the steam and fluidized material along the surface of a dish and off the dish, whereby the dish becomes clean or relatively clean. If such fluidizing and flowing caused by the steam, for example, is sufficient to effect washing of the dish, then additional washing functions may be unnecessary, such as, for example, those carried out in one or more of the other zones.

The length of the travel path 320, e.g., from the dish inlet 302 to the dish outlet 303 may be adequately short to allow for a dish to be manually placed in the inlet and while still held by one hand, for example, withdrawn through the outlet by the other hand. If desired, the arrangement of brushes 307*a*, 307*b* and the brush zone 307 may be suitable to provide support for the dish as it follows along the travel path 320 without the need for additional support.

The water used in the dishwasher 300 may be recycled. A valve 380 may be operated to direct water from the filter 363 back to the water zone 304. Recycling reduces requirements for water, soap, etc. and, therefore improves environmental advantages of the dishwasher.

Figure 10:
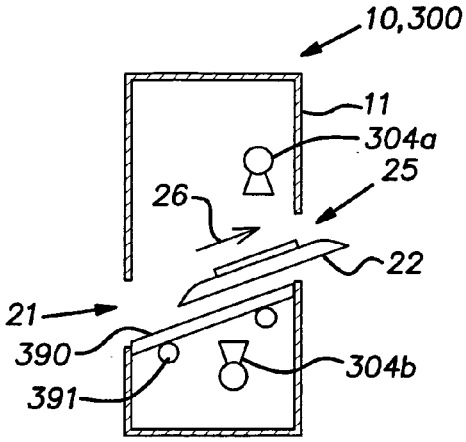
FIG. 10 is a schematic illustration of a dishwasher having a slopped travel path and one or more rails to help support a dish as it travels through the dishwasher.

In FIG. 10 is a side view of dishwasher 10, 300 with one or more rails 390 on supports 391. The rails provide support for a dish traveling through the dishwasher along the travel path 26 (shown as 320 in FIG. 9). The rails 390 may provide a sloped path from inlet 21 to outlet 25. The slope takes advantage of gravity as a dish is fed through the dishwasher 10. Also, the dish 22 is shown face down in FIG. 10; the dish may be fed face up or face down, depending, for example, on whether brushes and other fluid outlets are above or below the travel path 26 and/or depending on where the most dirt is on the dish. The dish 22 may be moved upward, as illustrated, through the dishwasher to obtain advantages of gravity as water spray pushes food, dirt, etc., off the dish and the waste drops down.

Figure 11:
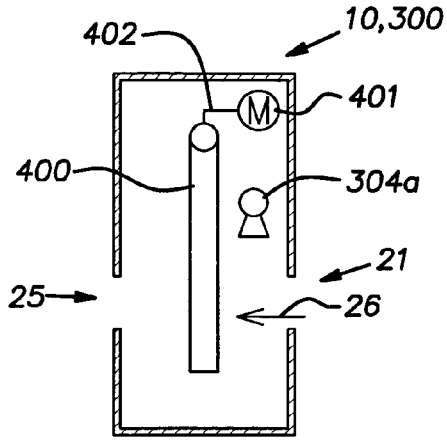
FIG. 11 is a schematic illustration of a dishwasher in which a fabric or leather type brush having a number of strap-like members is used to oscillate back and forth across a dish to wash the same.

Turning to FIG. 11, briefly, a dishwasher 10, 300 schematically is shown having a brush 400 that may include a number of strips of leather, fabric or other material to rub against a dish as it travels through the dishwasher along the path 26 from the inlet 21 to the outlet 25. Water may be sprayed from nozzle 304*a* toward a dish to wet the dish and also to maintain the brush 400 wet. The brush 400 may be similar to the type sometimes used in a car wash for brushless carwash functions, except that the brush 400 may be much smaller in size, e.g., to be suitable to wash a dish in the dishwasher 10, 300.

Other portions of the dishwasher 10 shown in FIG. 11 may be the same or similar to those described above. A motor 401 and coupling 402 to the brush 400 may move the brush back and forth across a dish or rotating and/or agitating or in a sense precessing in a suitable motion to effect the desired washing function, e.g., as is the case for a similar type of brush in a conventional carwash system.

Figure 12:
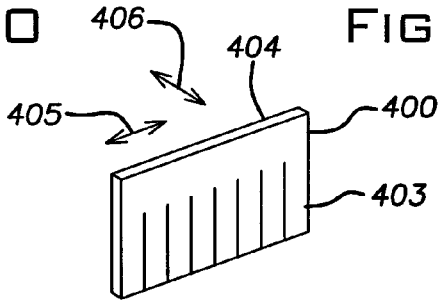
FIG. 12 is a schematic illustration of the strap-like brush used in the dishwasher of FIG. 11.

FIG. 12 shows the brush 400 with respective strips or flaps 403 hanging down from a primary support portion 404. The individual strips of flaps 403 may rub against different portions of a dish to effect the desired washing or rubbing type function of a brush. Steam, rinse water, drying air, ultra-violet light, etc. also may be provided in the dishwasher 10 of FIG. 11 using the brush 400. As the brush is moved by the motor 401 and linkage 402, the strips 403 may be moved laterally in the dishwasher, e.g., in the direction of the arrow 405, and/or may be moved longitudinally in the direction of the flow path 26, as also is represented by arrow 406 in FIG. 20; and/or the strip type brush 400 may be moved in a rotating motion.

Figure 13:
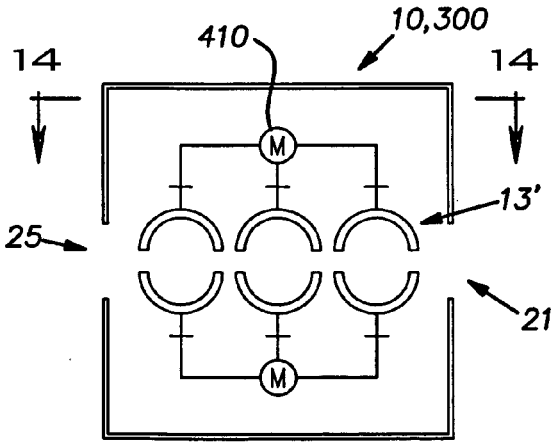
FIG. 13 is a schematic illustration of a dishwasher with a number of brushes.
Figure 14:
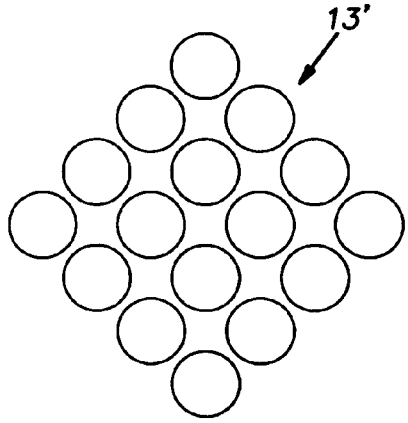
FIG. 14 is a schematic exemplary layout of brushes of the dishwasher of FIG. 13 looking in the direction of the arrows 14-14 thereof.

Turning to FIGS. 13 and 14 another layout of brushes 13' is illustrated for use in a dishwasher 10, 300 of the various types described above. In the dishwasher 10 the brushes are supported from above and/or from below the travel path 26. The brushes may face directly toward the travel path to rub against the top and/or bottom surfaces of the dish. The brushes 13' may be arranged in various layouts, one of which is illustrated in FIG. 14. The brushes are adequately flexible so that they may press and deform as they press against a dish. As is illustrated in FIG. 14, a layout of the brushes looking generally in the direction of the arrows 14-14 of FIG. 13 may include a number of brushes aligned to be sure to in effect rub against all parts of a dish passing along the travel path 26 through the dishwasher. The brushes 13' are turned by one or more motors 410 that are coupled by appropriate linkages to the brushes, e.g., mechanical linkages, fluid linkages, etc. to rotate the brushes. If desired, an offset cam may be used to effect a precessing of the brushes as they are rotated by the respective motors to help assure coverage over an entire surface (top and/or bottom) of a dish.

Turning to FIG. 15, a dishwasher 10 has a storage compartment 450 at the top thereof. In the storage compartment 450 is a tray, such as, for example, a wire tray, a metal tray having rubber coated portions, a plastic tray, or some tray that is generally illustrated at 451. The tray 451 may be used to hold drinking glasses, coffee cups, utensils or the like to carry them through the dishwasher. For example, a drinking glass 452 may be placed in the tray 451 and the tray may be placed in the dishwasher to carry the drinking glass through for washing purposes. If necessary, the motive system 210 may be operated to enlarge the inlet 21 and outlet 25 of the dishwasher to provide space for the tray with the drinking glass therein to be moved through the dishwasher. The tray may be used to carry silverware or other food manipulating types of utensils to the dishwasher. Those utensils may lie flat on the tray, may be held by a basket in the tray, etc.

The compartment 450 at the top of the dishwasher housing 11" provides a convenient storage facility for the tray 451. A door 453 may be used to close the compartment 450 to hide the tray when it is not in use and to maintain the cleanliness of the tray within the dishwasher.

In FIG. 15 the dishwasher the rinse water line 12*b*, the drying air line 81*t*, and the ultra-violet light source 309 are seen in dotted outline. To simplify the illustration, the splash guards are not illustrated in FIG. 15.

A Built in Dishwasher Arrangement

Turning to FIGS. 16-17 a combination dishwasher 500 is illustrated. The combination dishwasher 500 includes a conventional dishwasher 501 in which a dishwasher 10 of the type described above is positioned or mounted for use. The dishwasher 10 may be any of the various embodiments of dishwasher 10, 300, etc. described above. The dishwasher 10 may be referred to below as the personalized dishwasher 10 in the combination dishwasher 500 to facilitate distinguishing from descriptions pertaining particularly to the dishwasher 501.

In FIG. 16 the personalized dishwasher 10 is shown in the dishwasher 501 dishwashing cavity 502 in a stored position with the dishwasher door 503 closed. The dishwasher door 503 has a handle that may include a lock mechanism for example, which is shown at 504; and the dishwasher 500 may include a number of controls 505. The controls 505 may be used to operate not only the dishwasher 501 but also the dishwasher 10. Thus, the controls 505 may include one or more knobs, buttons, switches, timers, etc. to operate the dishwasher 501 in a conventional manner. The controls 505 also may include a number of controls to control the various operations of the dishwasher 10 that are described above with respect to the several embodiments of personalized dishwasher 10.

In FIG. 16 the door 503 is closed, and in FIG. 17 the door 503 has been omitted from the dishwasher cabinet or housing 506 for illustrative purposes to expose the interior of the dishwashing cavity 502 and to facilitate illustrating the relation of the dishwasher 10 to the dishwashing cavity. The dishwasher 10 is positioned on or is mounted on a support 510. Such mounting or positioning may include securing the dishwasher 10 to the support by fasteners, such as rivets, bolts, etc. Alternatively, the dishwasher 10 may be resting on the support 510 and be generally aligned in position thereon so that the dishwasher 10 will not ordinarily fall from the support. However, the dishwasher 10 in that example may be removable from the support 510 for use in a location other than that illustrated in FIG. 17 for cleaning or maintenance and/or for other purposes. The support 510 may include a support rod or bar 511 and a support track or rail 512, which is illustrated schematically. The rod and rail may be attached together by bent or convoluted portions thereof that interact with each other to hold the two together, and a number of rollers (not shown) may be used to facilitate sliding the rod 511 relative to the rail 512. Such arrangement of rod 511 and rail 512 to form the support 510 may be similar to the type of support structure often used in dishwashers to support dish racks relative to the dishwasher housing 506, for etc., while allowing the racks to be slid in and out of the dishwashing cavity 502. For convenience of illustration to show the dishwasher 10 relative to the dishwasher 501, the racks are not shown in FIGS. 16-17.

Using the combination dishwasher 500, the dishwasher 10 may be stored within the dishwashing cavity in the manner illustrated in FIG. 16, and in such case the dishwashing functions of the dishwasher 501 may be carried out in the conventional way. However, if only a few dishes need to be washed, rather than running the dishwasher 501, the door 503 maybe opened and the dishwasher 10 slid out from the dishwashing cavity 502 to a position similar to that illustrated in FIG. 17 ready for operation of the dishwasher 10. The dishwasher 10 may be used to wash dishes in the manner described above. For such purposes the dishwasher 10 may be coupled to the waterline provided to the dishwasher 501 and to the drain arrangement of the dishwasher 501. Electrical power for the dishwasher 10 also may be provided by connections from the dishwasher 501. Exemplary electrical connection 513, water connection 514 and drain connection 515 are illustrated schematically in FIG. 17. Different or additional power and/or fluid connections may be provided for the dishwasher 10.

Figure 18:
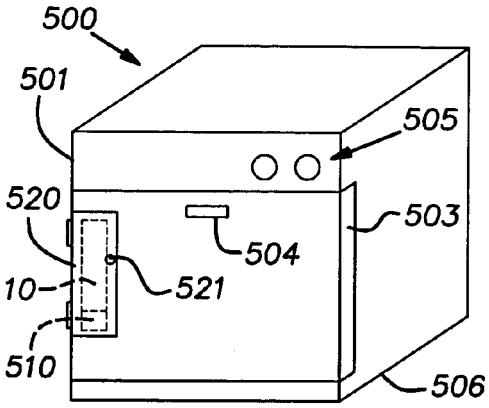
FIG. 18 is a schematic illustration of a combination dishwasher having a personalized front door.

FIG. 18 schematically illustrates another embodiment of combination dishwasher 500. In FIG. 18 the door 503 of the dishwasher 501 has a secondary access door 520. The secondary access door is connected by hinges 521 to the dishwasher door 503 or to another wall of the dishwasher 501 and a handle 522 may be manually operated to open the door 520 or to close it. Opening the door 520 allows access to the dishwasher 10 without the need to open the door 503. Opening the door 520 allows the dishwasher 10 to be slid out from the dishwashing cavity 502 to allow use of the dishwasher 10 without the need to open the door 503. Various devices such as pull tabs, spring loading, touch locks, and the like may be used to pull out or push out the dishwasher 10 on the support 510 for use in a manner illustrated in FIG. 17, but without the need to open the door 503 since the door 520 allows the dishwasher 10 to be moved to the position shown in FIG. 17 for use. After such use the dishwasher 10 can be pushed back inside the dishwashing cavity 502 and the door 520 can be closed. Appropriate seals, thermal and/or sound insulation may be provided for the door 520 and for the sealed relationship of that door with the dishwasher door 503.

Figure 19:
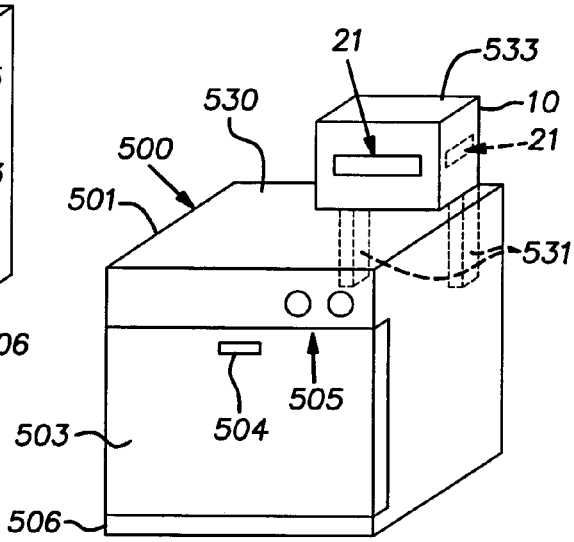
FIG. 19 is a front elevation view of a combination dishwasher.

Briefly referring to FIG. 19 a combination dishwasher 500 similar to the combination dishwashers 500 described above has the dishwasher 10 mounted in the dishwasher 501 to exit from the top 530 of the dishwasher housing 506. As is seen in FIG. 19, the dishwasher 10 is mounted on supports 531 and may be moved upward out of the dishwashing cavity 502 to the position illustrated in FIG. 19. The supports 531 may be track, rail, roller, or other arrangements. The top 533 of the dishwasher 10 may serve as a top part of the dishwasher housing 506 in a manner similar to that described above with respect to the top of the dishwasher 10 and counter top in FIGS. 5 and 6. A door (not shown) may be provided at the top 530 of the dishwasher cabinet 506; the door may be opened to allow the dishwasher 10 to be withdrawn out of the dishwashing cavity 502 to the orientation illustrated in FIG. 19 for use.

The dishwasher 10 may be used when exposed in the use position shown in FIG. 19. Such use may be carried out in the manner described above to wash dishes.

The various electrical and fluid connections and control functions that are described above with respect to the combination dishwasher 500 of FIGS. 16-17 may be used in others of the dishwashers disclosed herein, e.g., in FIGS. 18-21 and elsewhere.

Figure 20:
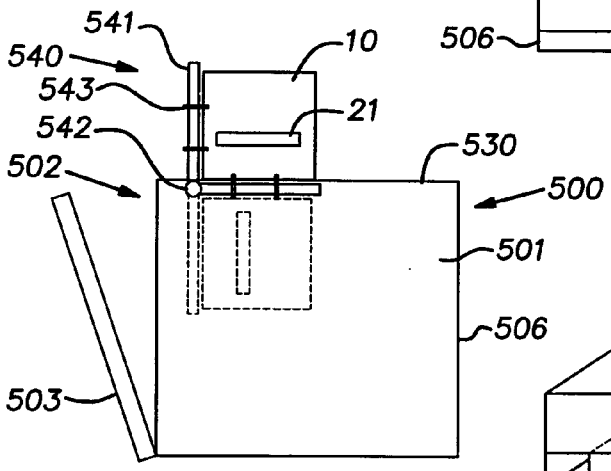
FIG. 20 is a side elevation view of a combination dishwasher having a rotatable support for the personalized dishwasher associated therewith, the personalized dishwasher shown in use position.

Briefly referring to FIG. 20, a combination dishwasher 500 is illustrated. This personalized dishwasher 10 is capable of being stored in the dishwashing cavity 502 or rotated for use at the top of the dishwasher. In FIG. 20 the door 503 to the dishwashing cavity 502 has been opened at least part way to allow the dishwasher 10 to be rotated up to the operative position shown.

The dishwasher 10 is mounted on a rotatable support 540, which may be, for example, a right angle bracket 541 that is mounted on a pivot 542. The dishwasher 10 is secured to the bracket 541 by suitable fasteners 543, e.g., bolts, rivets, adhesive, screws, etc. To use the dishwasher 501 of the combination dishwasher 500, the personalized dishwasher 10 may be in the stored position shown in dotted outline. The dishwasher 501 may be operated in conventional manner. To use the personalized dishwasher 10, the door 503 may be opened, and the dishwasher 10 may be rotated on the support 540 to the orientation illustrated in FIG. 20. The door 503 may be closed or partly closed after the personalized dishwasher 10 has been rotated and the personalized dishwasher 10 may be used in the manner described above.

In the several embodiments of combination dishwasher 500 additional housing arrangements or other protective mechanisms may be used to isolate the personalized dishwasher 10 from the water that would be distributed in the dishwashing cavity 502 during operation of the dishwasher 501, if desired. Various seals between walls of such protective mechanisms also may be used, if desired. However, with appropriate electrical power, water and drain connections and positional orientations of the personalized dishwasher 10 in the dishwashing cavity 502 of the dishwasher 501, it may be unnecessary to provide any additional protective mechanism for the personalized dishwasher 10.

Figure 21:
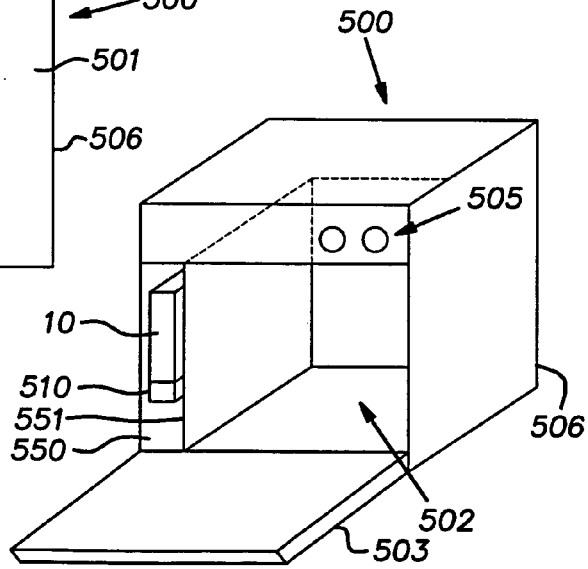
FIG. 21 is a schematic isometric view of a combination dishwasher with a separate compartment area for the personalized dishwasher.

Briefly referring to FIG. 21, a combination dishwasher 500 having a separate compartment 550 for storage of the personalized dishwasher 10 is illustrated. The compartment 550 may be formed by a wall 551 that co-operates with the dishwasher housing 506 walls. The compartment 550 may be wholly or partly fluidically separate from the dishwashing chamber 502 to avoid spraying water or other liquid on the personalized dishwasher 10 during operation of the dishwasher 501. The personalized dishwasher 10 may be mounted on a support 510 in the matter described above. With the door 503 open the compartment 550 is accessible, and the personalized dishwasher can be withdrawn to the position shown in FIG. 17, for example for use.

It will be appreciated that the various features of the embodiments of dishwasher illustrated and described have respective parts, features, methods of use, etc. The various parts, features, methods of use, etc. shown in one drawing figure and described with respect to that figure also may be used in connection with one or more of the other dishwashers illustrated and described herein.

Turning to FIG. 22, a rack arrangement is shown. The rack arrangement includes a rack 701, which may be used in place of rack 451 (FIG. 15) for applying steam, water, air or other fluid to beverage glasses, dishes or the like. The rack 701 is of a size and shape to carry one or more drinking glasses, coffee cups, tea cups, or the like or, if desired, one or more other dishes, bowls or the like. The rack 701 has a number of up-standing, e.g., relatively vertical, pins or pole-like members 702. The pole-like members 702 are mounted in a frame-like structure having support struts 703. One or more of the pole-like members 702 is hollow and has one or more openings 704 from the hollow interior to the exterior. One or more of the support struts 705 also is hollow and is connected to an input port 706. The input port 706 may receive steam from a steam supply and may deliver the steam via the hollow support struts 705 to one or more respective pole-like members 702; and the steam may exit respective openings 704 to impinge on the glasses, etc., in the rack to effect a cleaning and/or disinfecting function. It is advantageous to apply the steam directly to the glasses, etc., from a relatively proximate source, for example, to provide for a directed flow to/against the glass, etc., and/or to maintain the relatively high temperature of the steam to provide the desired cleaning and/or disinfecting function. Since the glass, etc. may be positioned directly on the rack 701, and since the steam may be dispensed directly from part of the rack, the function of the steam may be relatively optimized.

The rack 701 may be connected to a source of steam at the input ports 706. Glasses or dishes may be placed in the rack 701. While the rack is moved into the dishwasher chamber described above, the steam may be applied to the glasses, dishes, etc. The rack 701 may be withdrawn from the dishwasher chamber from the same direction it was inserted so that the input port(s) 706 do not have to be disconnected from the steam source. Alternatively, a snap coupling 707 may be used between the input port(s) and the steam source; and after the rack has been moved through the dishwashing chamber, the disconnect can be operated to separate the input port(s) 706 from the steam source.

It will be appreciated that although steam flow is described through the various flow paths of tubes, openings, etc. of the rack 701 other fluids may be directed through the respective flow paths and openings, e.g., washing liquid, water, rinsing fluid, disinfectant, etc.

Figure 23:
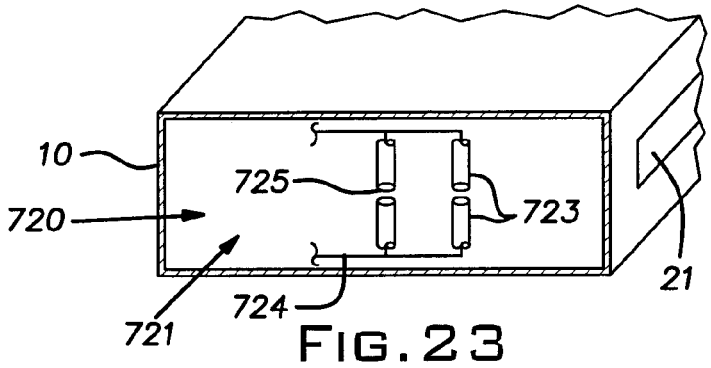
FIG. 23 is a schematic side view illustration of a dishwasher with tubes or hoses for dispensing steam.

FIG. 23 illustrates another embodiment 720 for dispensing steam in a dishwasher 10 according to the invention. In the dishwashing chamber 721 of the dishwasher 10, which is accessed from the entrance 722, there are a number of hoses or tubes 723 of rubber, plastic, metal or other material. Each of the hoses 723 is coupled via a flow connection 724 to a source of steam. The hoses 723 may be movable in the dishwashing chamber by a motive mechanism to move the hoses into the interior of a glass to dispense steam into the glass. The hoses 723 have openings 725, e.g., at the top and/or at the sides to dispense steam, e.g., as was described above with respect to the openings 704 described above. If desired, the hoses 723 may be flexible to rub against and deform in response to engagement with a glass, dish or the like thereby to provide the steam in close proximity to the glass, dish or the like.

Figure 24:
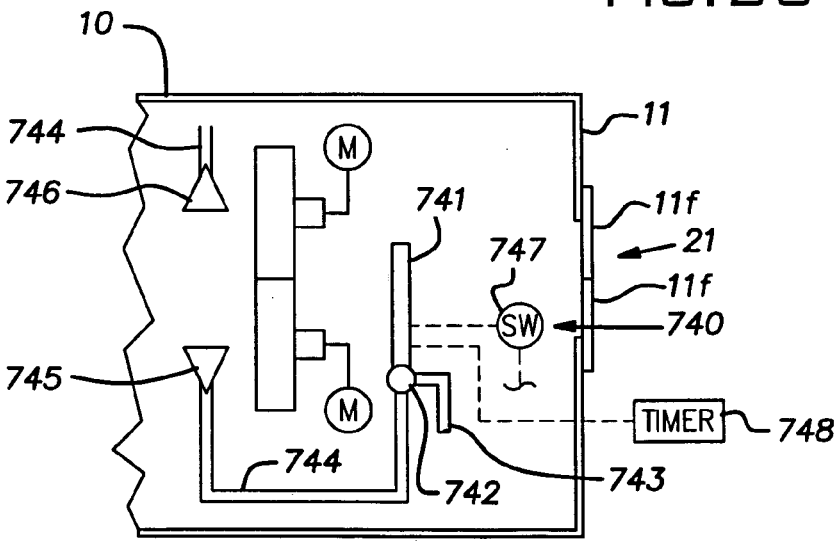
FIG. 24 is a schematic side elevation view of a dishwasher showing the dishwashing chamber and a switch responsive to a dish or the like engaging the sensor arm of the switch to affect operation of the dishwasher.

FIG. 24 illustrates an embodiment of dishwasher 10 using a dish sensing switch mechanism 740. A sensor arm 741 is moved, displaced or the like in response to force applied by a dish being moved into the dishwashing chamber. The sensor arm 741 is attached to a mechanical valve 742 that controls flow of steam from a steam inlet pipe 743 to a hose or pipe 744 leading to one or more steam nozzles 745, 746. Using a valve to control steam flow according to placement of a dish in the dishwashing chamber reduces unnecessary dispensing of steam until needed, conserves energy to generate the steam, etc. Thus, as a dish is moved into the dishwashing chamber, it moves the sensor arm 741 to open the steam valve. A spring return or other means may be used to move the sensor arm 741 and/or the valve 742 itself to a valve closed condition.

In FIG. 24 another switch 747 may be operated by the sensor arm 741. The switch 747 may control operation of other portions of the dishwasher 10, e.g., brush driving motor(s), water flow, and/or other functions of the dishwasher 10. Such switch 747 may operate various valves and electrical circuits. A timer circuit 748 or other means may be used automatically to turn off the dishwasher. The timer circuit 748 may be operated to start a timing cycle when the sensor arm 741 senses presence of a dish and/or when the switch 747 is operated to start a control function to operate the dishwasher.

Although various valves, switches, sensors and the like are described above, others equivalently may be used, as will be appreciated.

Figure 26:
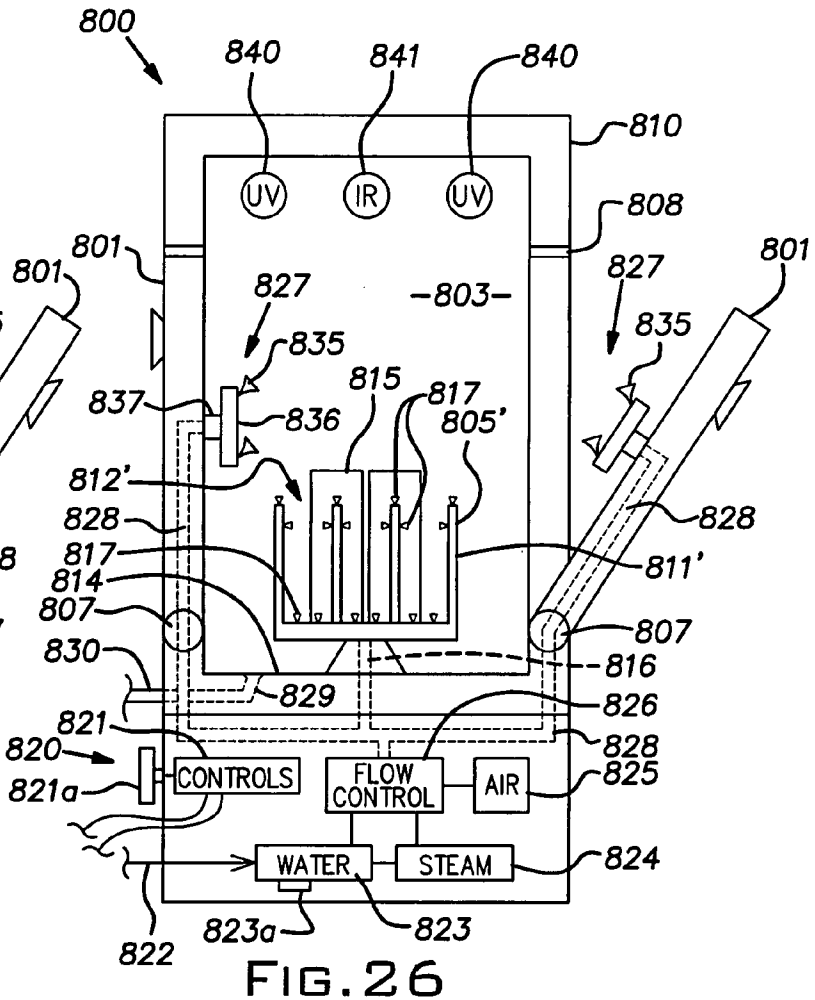
FIG. 26 is a schematic illustration of a personal dishwasher with a tilting door and space and a rack for washing several beverage glasses.
Figure 25:
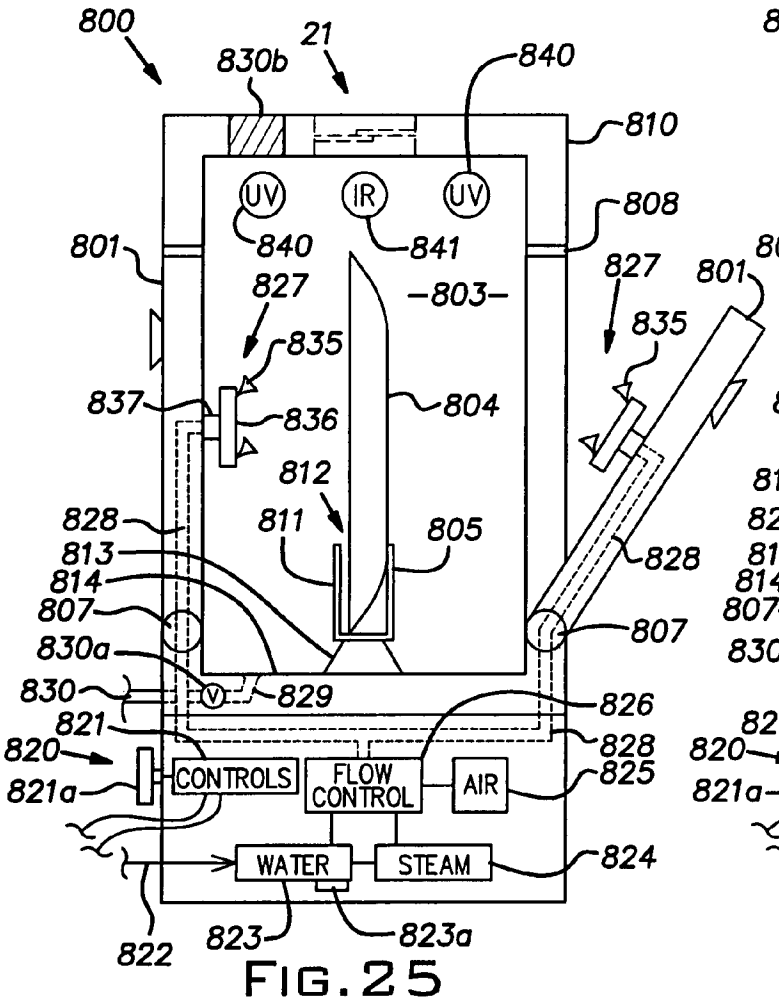
FIG. 25 is a schematic illustration of a personal dishwasher with a tilting door.

Turning to FIGS. 25-26, another dishwasher 800 in accordance with an embodiment of the present invention is illustrated. The dishwasher 800 includes a number of features of the dishwashers 10, 300, etc., which are described above. The dishwasher 800 has at least one door 801 that can be opened and closed to open and close a doorway 802 that provides access to the interior chamber (washing chamber) 803. In FIG. 25 the door 801 is shown open, and a dish 804 already has been placed on a rack or other support 805 (e.g., rack 701 or other rack as is described below, etc.) in the chamber 803. The door 801 may be pivoted about a hinge 807. A seal 808 may be provided about the doorway/door opening 802 to prevent water or steam from leaking from the chamber 803. The cabinet or housing 810 of the dishwasher 800 is waterproof to retain water and steam therein or otherwise to direct humidity, heat, etc., through vents, drains, etc. (not shown) from the chamber 803.

The dishwasher 800 is shown with a pair of doors 801. If desired, the dishwasher may include only one door. If there is one door, e.g., door 801, then the door can be opened to place a dish 804 in the chamber 803; the door can be closed; and the dish can be washed. The door then may be opened to remove the washed dish from the chamber 803. If the dishwasher 800 has two doors 801, 801*a*, then one door can be opened to place a dish in the dishwasher, and the other can be opened to remove the dish from the dishwasher. This process may expedite using the dishwasher, whereby at the conclusion of a washing operation both doors may be opened, and one hand may be used to remove the washed dish and the other hand may used to place a dish to be washed into the chamber 803.

The rack 805 may be a wire rack of a shape, configuration, size, etc. that provides some degree of universality as to be able to support dishes of 804 of different sizes and shapes, such as rather flat dishes, dishes with curved or raised edges and bottoms, bowls, etc. The rack 805 may have a number of upstanding pin-like members 811 with mesh or other material between respective pin-like members; and the space 812 in which an edge of the dish 804 is placed may be tapered, stepped, have slopped walls, etc., as may be desired to provide adequately secure retaining of a dish 804 for washing. Other forms, shapes, parts, etc. of various rack designs may be used for the rack 805. If desired, the pin-like members 811 and/or other parts of the rack 805 may be coated with a noncorroding and/or non-rusting material, e.g., a plastic or rubber material that protects underlying metal of the pin-like members and/or other portions of the rack and that also void damaging the dish 804. The pin-like members and/or other portions of the rack 805 may be made of a material other than metal, e.g., plastic, polymer, rubber, etc. One or more legs 813 may be used to support the rack 805 above the floor 814 of the chamber 803 so that the dishes may be placed in position in the chamber 803 so as to allow for washing all areas of the dish from above and below. Also, spacing between respective pin-like members 811 and/or mesh or other parts of the rack 805 may be such as to allow slight movement of the dish 804 in the rack, although it is being held relatively securely therein as not to fall, so that slight movement of the dish allows for washing of all areas of the dish.

Briefly referring to FIG. 26, another rack 805' is illustrated in a dishwasher 800. The rack 805' has a number of upstanding pin-like members 811' defining a space 812' where one or more drinking glasses, mugs, cups, etc., which are illustrated schematically at 815 may be placed. One or more of the pin-like members 811' may be hollow to provide a flow through passageway and fluid distribution mechanism for water, steam, wash water, hot air (for drying for example), etc., as the rack 701 described above. A fluid connection 816 to the rack 805' provides such fluids. Openings 817 in the side walls of the pin-like members, at the top of the pin-like members, and at the bottom of the rack 805' provide outlets for such fluids to wash the glasses 815, etc.

Figure 27:
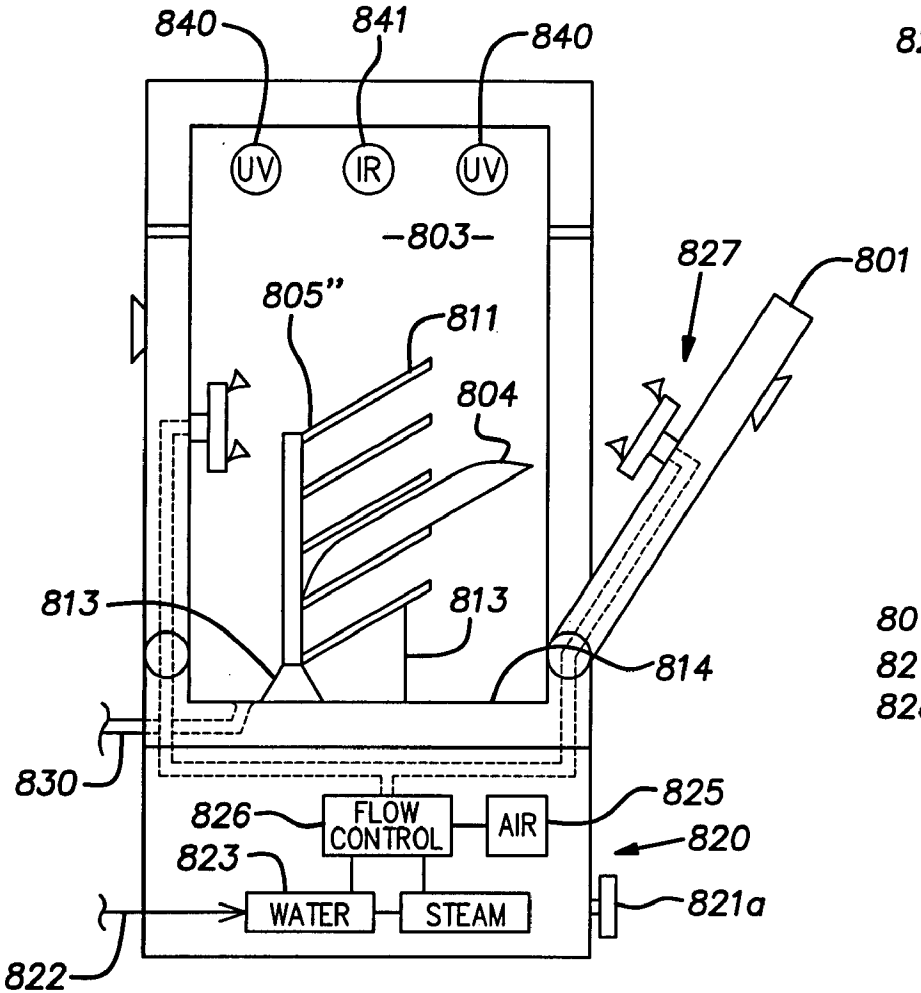
FIG. 27 is a schematic illustration of a personal dishwasher with a rack for holding several dishes at an angle other than horizontal or vertical.

In FIG. 27 another type of rack 805" is illustrated. The rack 805" includes a number of pin-like members or arms on which respective dishes 804 may be placed for support at a diagonal plane relative to vertical and horizontal directions in a dishwasher chamber 805 for washing. The rack 805" is supported by one or more legs 813 from the bottom 814 of the dishwasher chamber 803.

The dishwashers 800 of FIGS. 25-27 have a control and distribution section 820. The control and distribution section 820 includes one or more controls 821, a water inlet 822 that provides water to a reservoir 823 and to a steam generator 824. An air supply 825 also may be included in the control and distribution section 820. A flow control 826 controls the distributing of water from the reservoir 823, steam from the steam generator 824, and air from the air supply 825 to one or more outlets generally shown at 827 and from the outlets 817, if used, in the rack. A flow path 828 provides fluid connections, from the flow control 826 to the outlets 827 and via the flow path 816 to the rack outlets 817. A drain 829 at the bottom 814 of the chamber 803 is connected by a connection, pipe, hose, etc., 830 to a drain pipe, sink drain, trap, etc., for disposal and/or recycling of the water from the chamber 803.

A knob 821*a*, which represents one or more buttons, knobs, switches, etc., of the dishwasher 800 is coupled to the controls 821 to operate the same and to provide for desired operation of the dishwasher 800, as will be described below.

The water reservoir 823 may include a heater to heat the water supply the via the water inlet 822. The water reservoir 823 may include a storage facility to store water for use in forming steam and to provide water for washing dishes 804 and/or for rinsing the dishes. The water reservoir may include a pressurizer to pressurize the water or other fluid for delivery to wash dishes at a relatively high volume and velocity. The water reservoir 823 may include a dispenser 823*a* for dispensing detergent or the like, welting agent or the like, or some other ingredient to the water in the water reservoir 823 for the usual purposes of washing, rinsing, etc., a dish 804 in the chamber 803. The steam generator 824 may include a heater suitable to heat water from the water reservoir 823 or directly received from the water inlet 822 to form steam to be distributed in the chamber 803 for cleaning dishes 804. The steam also may be used to destroy at least some bacteria that may be on the dish 804 or contained in food that is on the dish 804. The steam also may destroy at least some bacteria that otherwise is in the chamber 803. The air supply 825 may be a fan, a source of compressed air, a heater, etc., able to provide suitable air flow for the purpose of drying a dish 804 in the chamber 803 after the dish has been washed, for example.

In the dishwashers 800 the outlets 827 include respective nozzles 835. The nozzles are mounted on a rotating support 836, and fluid (e.g., one or more of rinse water, wash water, steam, air) is provided the nozzles via the flow paths 828 to be directed toward a dish 804 in the dishwasher chamber 803. The supports 836 preferably are rotatable from a base 837, and the nozzles 835 are positioned relative to the support 836 to tend to cause the support and, thus, the nozzles to rotate about the respective bases 837. The rotating nozzles tend to distribute fluid over the entire dish 804 or at least over substantially the entire dish 804.

The illustrated fluid outlets 827 in the form of rotating nozzles 835 are exemplary. Other types of fluid outlets 827 may be used.

Figure 29:
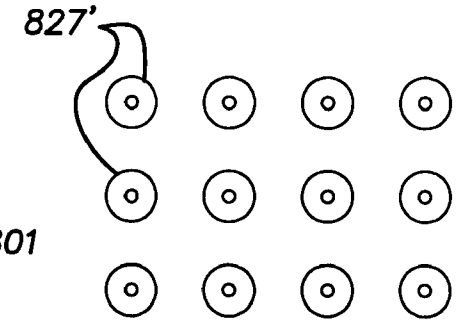
FIG. 29 is a front elevation view of a nozzle layout of FIG. 28.
Figure 28:
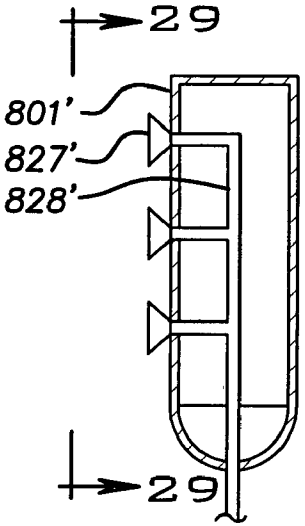
FIG. 28 is a side elevation view of a nozzle layout for a personal dishwasher.

For example, in FIGS. 28-29 are illustrated side section and front elevation views, respectively, of a dishwasher door 801' having a number of outlets 827' in the form respective relatively fixed spray nozzles. The outlets or nozzles 827' are distributed across the face of the door 801' and are supplied by fluid via a flow path 828' that passes through the door, as is seen in FIG. 28, for example.

The layout of outlets 827' is such as to provide for suitable washing of one or more dishes, glasses, etc. in the dishwasher chamber 803. If desired, the nozzles 827' may be located not only on the door 801' but also on other side walls, the top, and/or the bottom of the dishwashing chamber 803. The arrangement of outlets 827, 827', nozzles, etc. for the dishwashers 800 of FIGS. 25-29, for example, is such as to provide suitable washing and drying functions.

Referring to FIG. 25, an example of use and operation of the dishwasher 800 is described by way of example. A door 801 is opened, and a dish 804 is placed in the rack 805. The door 801 is closed. The chamber 803 then is relatively fluid tight to avoid leakage of water, steam or air from places where it is not intended to leak from the chamber 803. The controls 821 may be operated by the knob and other switches, buttons, slide controls or the like 821*a* to assure that the water is heated at 823 (if heating is used), that steam is formed at 824 (if steam is used), and that air is available at 825. The controls 821 operate the flow control 826 initially to direct water through the flow path 828 for spraying against the dish 804. Thereafter, steam may be directed by the flow control and flow path 828 to be directed toward the dish 804 for further washing. Steam may be effective to remove material, e.g., dried egg, and/or material from the dish 804; and the steam also may have a disinfecting function. The flow control 826 may be operated to direct not only water from the water reservoir 823 for washing the dish 804, and in such case that water may include detergent, wetting agent, etc. from the reservoir/dispenser 823*a*, but also to rinse the dish 804, for example, as a step following the washing step. The water alone may be sufficient to complete the desired washing. The controls 821 may operate the flow control 826 to stop directing water and steam toward the dish 804 and then to direct air from the air supply 825 to the dish 804 for tending to wash water off the dish, to cool the dish after steam had been directed on it, and to dry the dish. The foregoing may be considered a wash cycle (including the drying portion of the cycle, if such drying takes place). A door 801, 801*a* to the dishwasher chamber 803 can be opened and the dish may be removed.

A wash cycle may take as short as a number of seconds, e.g., on the order of less than about ten seconds. A wash cycle may take a longer or shorter period of time. As an example, washing and drying may take from about three to about ten seconds. The duration of the wash cycle may depend on a number of factors, such as, for example, how dirty is the dish, how many outlets 827 are used, what is the velocity, pressure and quantity of the fluid that is directed to the dish, water temperature, steam temperature, air temperature, water, steam and air pressure and/or flow rate(s), etc.

During or after the wash cycle water from the chamber 803 may be removed via the drain 829 and drain pipe 830. A suitable valve 830*a* may be used to control flow through the drain. Additionally, one or more vents 830*b* that may have a reasonably tortuous, e.g., non-linear path may be provided in the dishwasher cabinet 810 to exhaust air and/or humidity, water vapor, etc., as may be desired. Suitable cooling may be provided for steam in the chamber 803, e.g., by directing a cooling air flow from the outlets 827 into the chamber 803 after a steam cycle. Cooling water may be directed in to the chamber 803 via the outlets 827 to cool any steam and/or condense the same for removal via the drain 829.

As is illustrated in FIG. 25, a dish may be placed in the chamber 803 in the generally upright fashion whereby the plane of the dish is in a vertical direction. However, if desired, the direction of the orientation of a dish 804 may be some other direction, e.g. generally horizontal or angularly between horizontal and vertical (FIG. 27). Ultraviolet energy from one or more ultraviolet lamps 840 in the chamber 803 or located in such a manner as to direct ultraviolet energy through a passage into the chamber 801 may be provided to kill bacteria in the chamber and/or on the dish 804. Also, one or more sources of infrared energy generally indicated at 841 may be used to provide a heating function to heat the dish 804 and/or fluid in the chamber 803, as may be desired. The controls 821 may be coupled to such sources of ultraviolet energy and/or infrared energy to control operation thereof to supply the appropriate energy in the dishwasher 800.

The dishwashers 800 may have an opening at the top (or at an end) that may serve as both entrance and exit, e.g., as is shown at 21, for inserting dishes into the chamber 803 for washing and for removing the dishes. Such top insertion may avoid the need to use a door 801 for such purpose.

Figure 30:
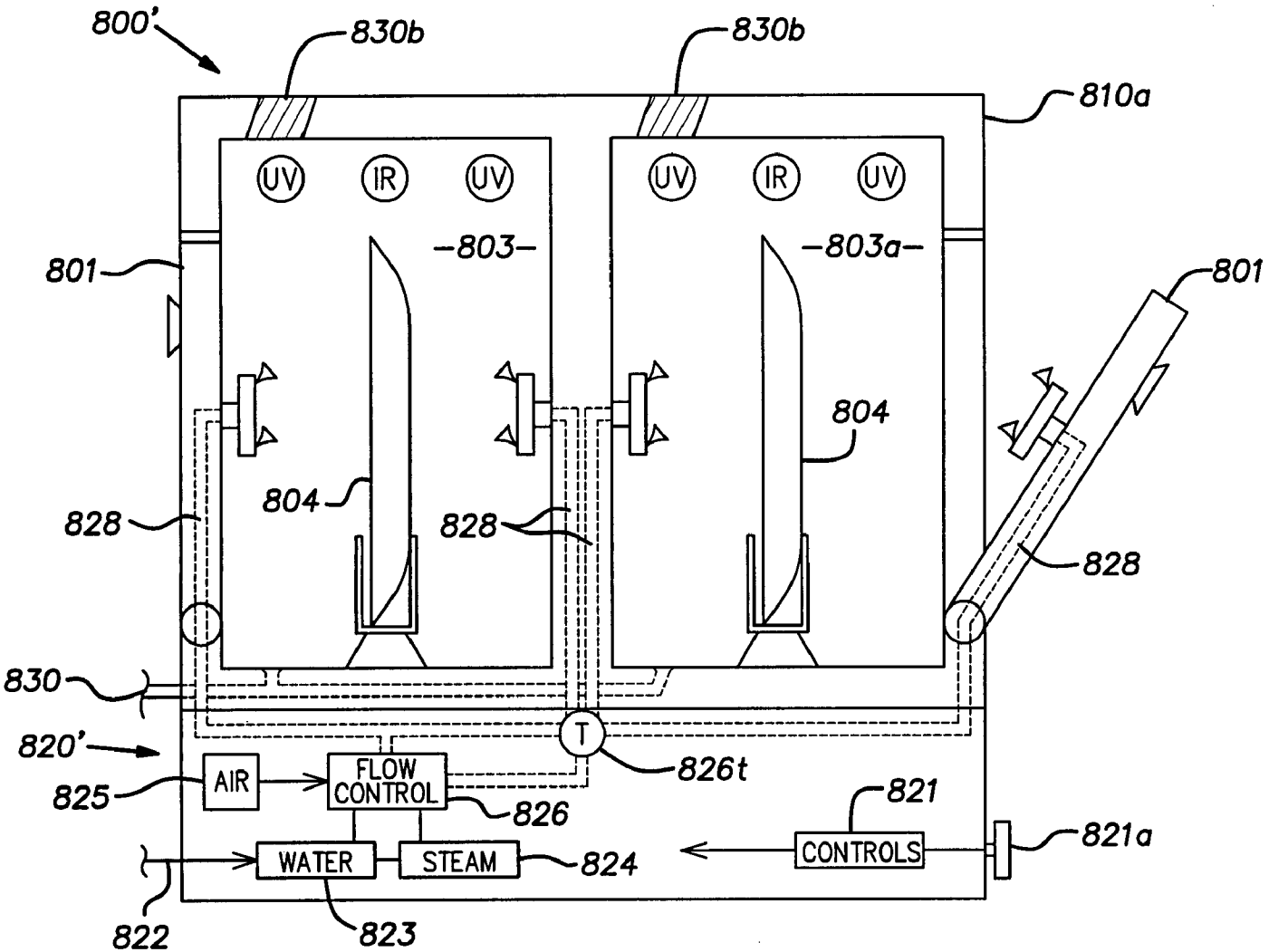
FIG. 30 is a schematic side elevation view of a two dishwasher chamber arrangement for a personal dishwasher of the invention.

Briefly turning to FIG. 30, a modified dishwasher 800' is illustrated. The dishwasher 800' is similar to the dishwasher 800 except the dishwasher 800' has a pair of dishwasher chambers 803, 803*a* formed in the cabinet 810*a*. The control and distribution portion 820' of the dishwasher 800' is similar to the controls and distribution portion 820 of the dishwasher 800 except that such portion is appropriate to control operation of the dishwasher 800' to wash two dishes 804 in the respective dishwasher chambers 803, 803*a*. If desired, the dishwasher 800' may be operated such that a dish 804 is placed in the dishwasher chamber 803 and the door to that chamber is closed. The controls and distribution portion 820' then operates those portions of the dishwasher 800' to wash the dish 804 in the chamber 803. While that dish is being washed, the door to the chamber 803*a* can be opened and another dish 804 can be placed in the chamber 803*a*. The door to the chamber 803*a* can be closed, and by the time that door is closed or shortly afterwards, the door to the chamber 803 can be opened to allow removing of the dish 804*a*. The control and distribution portion 820' may be operated so that the respective dishes in the chambers 803, 803*a* are washed sequentially/alternately as one dish is placed in a respective chamber and one is removed from the other chamber in sequential or serial fashion. A T-valve 826*t* that is controllable by the flow control 826 may be operated to direct flows along respective flow paths 828 to wash one dish or the other in the respective chambers 803, 803*a*.

Figure 31:
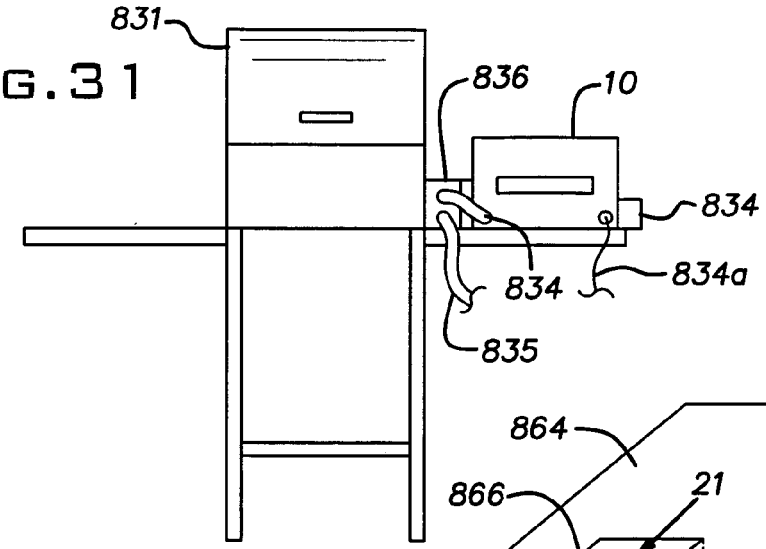
FIG. 31 is a schematic illustration of a gas grill for other barbecue grill or the like, and a dishwasher of the present invention positioned in proximity to the gas grill.

In FIG. 31 is a patio grill 831 with a dishwasher 10, 300, 800, etc. positioned with respect to the grill. The patio grill 831 may be a gas grill, charcoal grill or some other type of portable (or permanent) grill or cooking appliance. The gas grill appliance has a support tray 832 on which a dishwasher 10, for example, is mounted or positioned. The dishwasher 10 may be totally portable having a supply of water 833 and a power supply 834. The supply of water 833 may be a reservoir that is filled up using a hose or some other fluid supply. The power supply 834 may be a battery. If desired, the water supply may be provided to the dishwasher 10 by flow line 835, such as a coupling for a garden hose of the like. Also, if desired, electrical power for the dishwasher 10, to operate the motors, to rotate brushes to provide heat to make steam, etc. may be provided by the portable power supply 834 or by an electrical connection 834*a* to a conventional electrical outlet supplied with electrical power from the utility company. Moreover, if desired, the electrical power can be eliminated and hydraulic power may be used to rotate the brushes via water supplied under suitable pressure from the hose connection at 835. Thus, it will be appreciated that the dishwasher 10 showing FIG. 31 is portable and can be placed out on a patio, taken to a picnic, and otherwise used to wash dishes wherever needed; and a user may cook and wash at the same location very conveniently.

A heat exchanger 836 may receive water from the hose connection 835, for example, and provides for heating of the water using heat from the grill 831 or other appliance. The heated water then may be coupled by a connection 834 to the dishwasher 10. If desired, the water supply for the dishwasher 10 in FIG. 31 may be at the bottom of the dishwasher. The dishwasher may be placed on top of the grill 500 after the grill has been used for cooking. The heat from the grill may be used to heat the water in the dishwasher for washing dishes. If the heat is sufficient to boil the water to create steam, the various functions using steam, as are described above, also may be carried out using the dishwasher.

Figure 32:
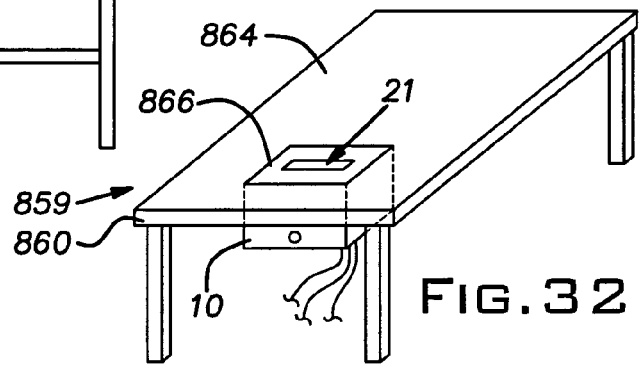
FIGS. 32-34 are schematic illustrations of a dishwasher built-in to a table.
Figure 33:
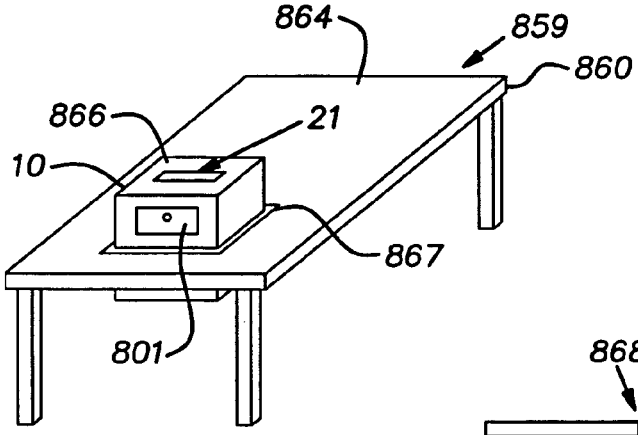
Figure 34:
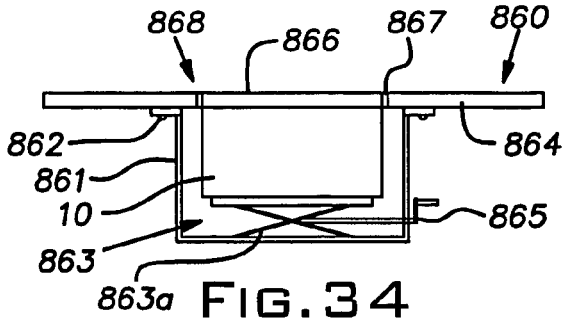

Turning to FIGS. 32-34 another built-in arrangement 859 for a dishwasher (10, 300, 800, etc.) in accordance with the invention is illustrated. The dishwasher is built in to a table 860, e.g., a kitchen table or a dining room table. A bracket or housing 861 is mounted beneath a table 860 by suitable fasteners 862, e.g., bolts, screws, nails, etc. A lifting mechanism 863 may be operated to raise the dishwasher from a stored position beneath the top 864 of the table to a raised position for access to the dishwasher to wash dishes. One example of lifting mechanism 863 is a scissors jack 863*a* that may be raised or lowered by operating a crank 865. Other types of lifting mechanisms also may be used to raise and to lower the dishwasher relative to the table 860. Examples of other lifting mechanisms include hydraulic devices, screw lift devices, spring loaded devices, jacks different from scissors, jacks, etc.

The top 866 of the dishwasher may be of a material that is suitable to be used as part of the top 864 of the table 860 as was described above with respect to the counter top of FIG. 5. For example, if the table top 864 were made of wood, a wood covering may be at the top 866 of the dishwasher. Other suitable material may be used for the top 866 of the dishwasher so that it provides similar functions as the table top 864 without damaging the dishwasher. A seal 867 may be provided about the opening 868 in the top 864 of the table. The seal 867 may engage side walls of the dishwasher to block the dropping of crumbs, liquid or other objects beneath the table top 864 through the opening 867.

Using the built-in arrangement 859 of dishwasher 800 (or one of the other dishwashers hereof), the dishwasher may be maintained in its in stored position while the table 860 is used in normal fashion. However, when it is desired to use the dishwasher to wash dishes, the crank 865 can be turned to operate the scissors jack to lift the dishwasher to the use position, and dishes then can be washed in a manner described above. The dishwasher can be re-stored beneath the table 860 by lowering the scissors jack. The built-in arrangement 859 may be used in a table, a counter, cooking system, barbeque grill, patio table, etc.

Several of the dishwashers that are described above and are illustrated in the drawings depict a dish oriented for washing while the major planer extent of the dish is generally horizontal; other dishwashers show the dish oriented such that the major planer extent is generally vertical; and others illustrate the dish having its major planer extent arranged generally in an orientation that is at an angle between vertical and horizontal. It will be appreciated that various features of the invention may be used and reoriented to provide for placement of dishes in a dishwasher or movement of dishes through a dishwasher such that the major planer extent of the dish generally is horizontal, generally vertical or generally at an angle other than horizontal or vertical. Various advantages may inure to the particular placement or orientation of a dish in a dishwasher hereof. For example, with the major planer extent in a generally vertical direction, it is relatively easier for water to drip or to roll down the surfaces of the dish to facilitate drying. Placement of a dish such that the major planer extent is generally horizontal with the eating surface up may allow for wash water with detergent, rinse water, and/or steam to remain on the surface of the dish longer than if the dish were in a vertical orientation. Placement of a dish such that the major planer extent is horizontal and the eating surface is down may facilitate the dropping of food particles off the dish during the washing process. Various other advantageous may inure to the orientation of parts of the dishwasher and orientation of a dish in the dishwasher during the washing and/or drying process and/or during the process of placing a dish in and removing a dish from the dishwasher.

Figure 35:
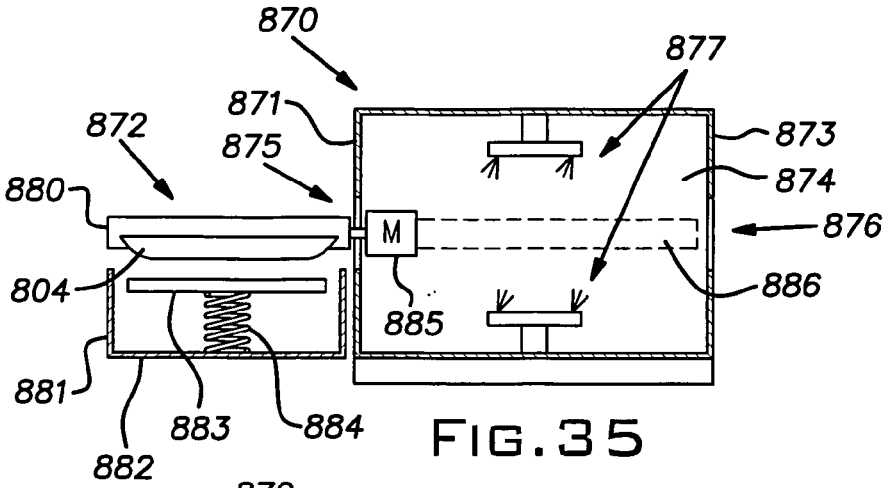
FIGS. 35-37 are schematic illustrations of a dishwasher with loading and unloading apparatus.
Figure 36:
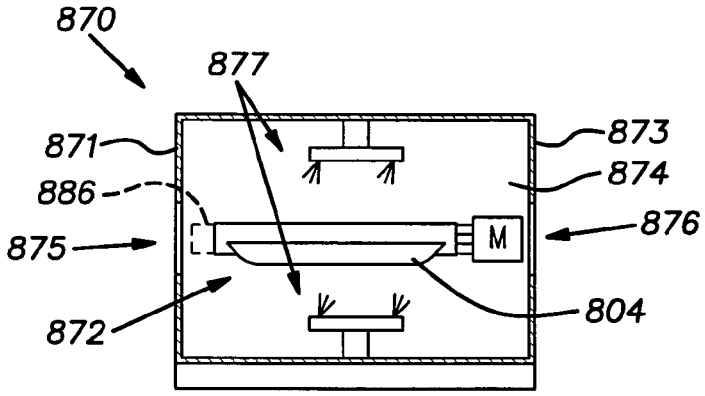
Figure 37:
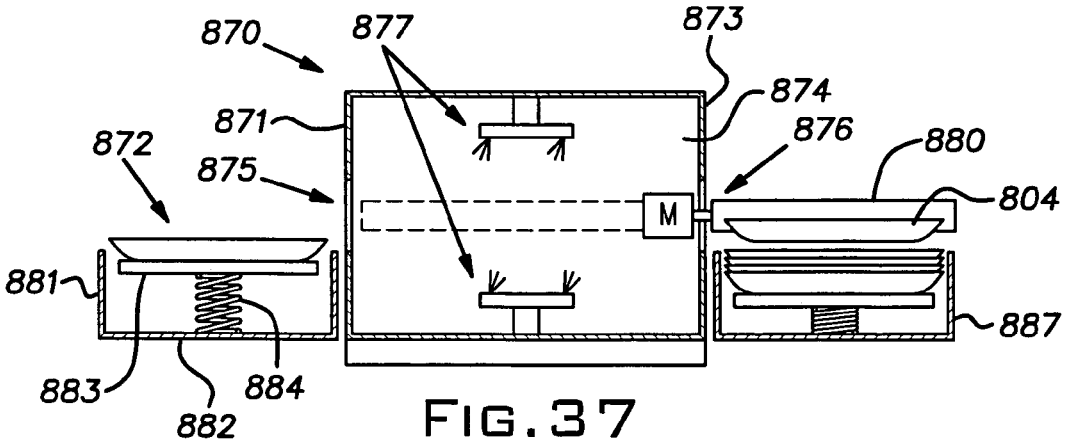

An automated dishwasher system 870 is illustrated in FIG. 35-37. The automated dishwasher system 870 includes a dishwasher 871 and a dish transport system 872 (PARTLY SHOWN IN FIG. 35, not shown in FIG. 36, and fully shown in FIG. 37). The dishwasher 871 may be any of the dishwashers described above or another dishwasher capable of washing one or more dishes at a time. In the illustrated dishwasher 871, the dishwasher is able to wash a single dish at a time.

The dishwasher 871 includes a housing or cabinet 873, a dishwashing chamber 874, entrance and exit doorways 875, 876, and a washing system 877. The washing system 877 may include a number of nozzles that are rotatable to spray water, wash water with detergent, steam, air, etc., to a dish for washing the dish. Various spray systems are described above, and these may be used for the wash system 877, as may be other spray, wash, brush, etc. systems. The doorways 875, 876 may include flexible seals, e.g., plastic strips, rubber strips, fabric strips, or other devices that allow a dish 804 to be transported through the doorway to enter or to exit the dishwasher chamber 874. If desired, there may be only a single door, and the dish may be placed into and removed from the chamber 874 by that single doorway.

An exemplary transport system 872 is illustrated. The transport system includes a grasping device 880 able to grasp a dish 804 and to carry the dish into the dishwasher 874 via the doorway 875. The dish may be preliminarily contained in a storage rack 881. The storage rack may include a bottom 882, a moveable support surface 883, and a spring support 884. The dish 804 may be placed on the support 883 in the storage rack 881, and the spring 884 may be adequate to push the dish sufficiently upward in the storage rack 881 for grasping by the grasping device 880.

The transport system 872 also includes a motor 885, a track 886, and appropriate mechanism, e.g., a cog or gear mechanism, etc., that allows the motor to slide or to be driven along the track 886 to carry the grasping device 880 and dish 804 into the chamber 874 to the orientation illustrated in FIG. 36, for example. With a dish in the chamber 874 it may be washed. After washing, the motor 885 may rotate the grasping mechanism 880 and dish 804 to transport the dish out the doorway 876, for example, for placement in another rack 887, which may be similar to the rack 881. The one or more dishes in the rack 887 may be stored for subsequent use and/or for removal and placement in a cabinet for storage, etc.

The motor 885 may include various gears, linkages, pivots, as well as an electric or hydraulic motor to operate the grasping 880 to grab hold of a dish 804 and to release a dish with respect to the racks 881, 887. The motor 885 also may include the ability to pivot the dish within the dishwasher in a horizontal plane, for example, or in some other way to place the dish in position for washing and to place the dish in position for discharging from the dishwasher through the doorway 876, for example so the dish then can be placed in the rack 887. Controls and distribution system 820 of FIG. 25, for example, and the various water, electric and drain connections may be provided the dishwasher system 870 for operating the dishwasher in the manner described above and the manner described with respect to the other drawing figures hereof.

The grasping device may include a fixed arm 980 that is connected to and supported from the motor 885. The grasping device also may include fixed and relatively movable flange-like portions that are movable to grasp and to release a dish for pickup from and release to the respective racks 881, 887.

It will be appreciated that the transport mechanisms shown in FIGS. 35-37 are illustrative and that other port systems may be used to move dishes into and out from the dishwasher chamber 803 for washing and may be used to pick a dish to place it in the dishwasher and to deliver a dish for storage or for subsequent use, etc. after the dish has been washed.

Figure 38:
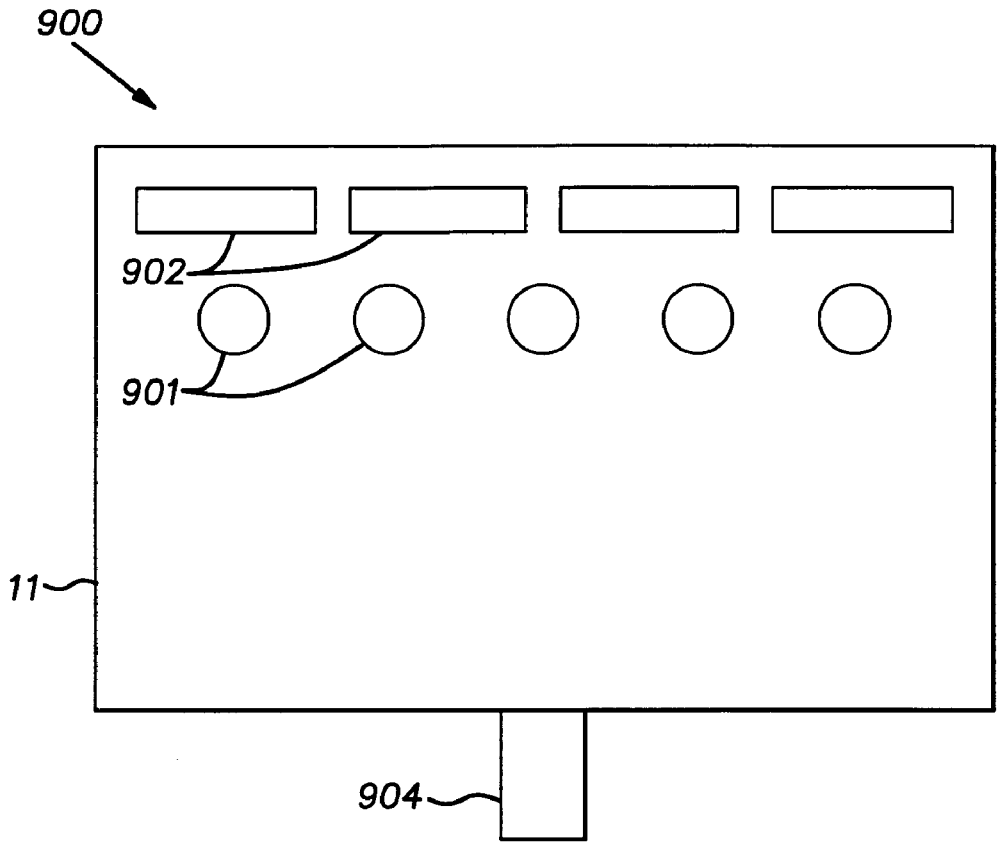
FIG. 38 is a plan view of one wall of a dishwasher useful in several embodiments including several water spray nozzles and air knives for distributing water for washing and air for drying a dish in the dishwasher.

Briefly referring to FIG. 38, a layout of arrangement 900 for water spray nozzles 901 and air outlets 902 is illustrated in a wall 11 of a dishwasher according to the invention. The layout 900 is for one of the two major walls of a dishwasher housing 11, e.g., dishwasher 10 of FIG. 1A or 1B, for example. The layout 900 may be used in any of the other dishwashers of the invention. In the dishwasher a dish is inserted vertically between the two walls, and the spray from nozzles from both sides of the dishwasher is directed simultaneously toward both faces of the dish. The dish may be inserted fully into the dishwasher and then withdrawn from the dishwasher. The spray may be directed toward the dish both during insertion and withdrawal of the dish or may be only during one of those directions. If necessary for additional cleaning of the dish, the dish may be reinserted and removed from the dishwasher.

As the dish is withdrawn from the dishwasher, the air outlets 902 direct air at both surfaces of the dish to blow water off the surfaces for drying. The air outlets 902 may be the outlets of a conventional air knife type device. The air flow is analogous to the air curtain 310*c* mentioned above at the description of FIG. 9. The air flow may be provided simultaneously while water is being sprayed from the nozzles 901 or may be a second step, whereby the dish is reinserted into the dishwasher after the water flow is terminated; and then the air flow is provided to dry the dish.

Since the dish is moved vertically, the advantage of gravity may be used. The primary washing function to wash dirt from the dish may occur as the dish is withdrawn upward, whereby dirt and water are pushed down and off the dish. Similarly, the primary drying function may be carried out while the dish is being withdrawn from the dishwasher.

A pressurizer for the water may be provided. Exemplary pressurizers may provide flow so that the water is provided the nozzles at about 40 to 70 pounds per square (psi) inch per nozzle. The pressures are exemplary only and are not limiting. The number of nozzles 901, their spray pattern, and the amount of water sprayed from each may be coordinated with the pressurizer and the size of a dish so that adequate spray, pressure and velocity of water impinging on the dish is adequate to obtain suitable washing. The direction of spray also may be adjusted to obtain suitable washing.

Air pressure from the air outlets 902 may be on the order of 20 psi. A source of air pressure of, say 80 psi, divided by four may be adequate to obtain such air pressure.

Example 1: Using a dishwasher of the type illustrated in FIG. 38, with nozzles and air outlets on both sides, an approximately dinner plate size dish is washed substantially washed clean and substantially dried in from about 3-10 seconds using only water and air at the respective nozzles and air outlets.

If ultra-violet illumination is used, the energy may be selected to be adequate to kill intended bacteria, germs, etc. As an example, which is not intended to be limiting, is 260 newton meters for substantially instantaneous killing of at least some bacteria or germs upon impingement of such ultra-violet energy on a surface of a dish.

If steam is used in the dishwashers described herein, temperatures on the order of from about 65 C. to about 75 C. may be adequate to kill some bacteria or germs; other temperatures may be needed to kill other bacteria or germs.

Water and waste may flow out through a drain 904. The water may be recycled.

If desired, controls may be provided, e.g., the control system 820 may be used, to pulse the operation of fluids in the dishwasher. For example, the water and/or the air flow may be pulsed, e.g., turned on and off, or changed in pressure, during operation of the dishwasher.

Figure 39:
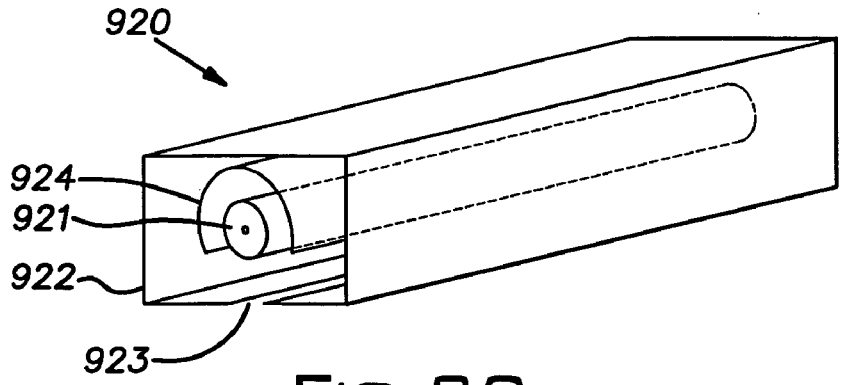
FIG. 39 is a schematic illustration of an ultra-violet system for use in the several embodiments of dishwasher of the invention.

FIG. 39 illustrates an exemplary ultra-violet electromagnetic energy system (UV light) 920 for use in the invention. The system 920 includes a UV lamp, such as an elongate tube 921. The lamp 921 is in an elongate light impermeable housing 922 that has an elongate slit 923 that faces the area in a dishwasher where a dish is to be disinfected as the dish passes out from, into and/or along the dishwasher chamber. A reflector 924 in the housing 922 helps to concentrate and/or to focus UV light to the desired area, e.g., onto a dish. A lens also may be provided to tend to focus UV light to the desired area. Using a housing 922 blocks UV light from exiting the dishwasher chamber and using the reflector and elongate lamp along with the relatively narrow slit 923 helps to concentrate the UV light at the desired area, e.g., onto a dish.

If desired, instead of or in addition to the ultraviolet energy source(s), infrared sources also may be provided, e.g., as the ultraviolet energy sources are provided. The infrared sources may provide heat to clean the dishes, to kill bacteria, and/or to pre-warm the dishes for subsequent use with warm/hot meals.

Furthermore, if desired, the fluid distributing systems of the invention may include not only a source of water and/or a source of steam, but also a source of plasma, and/or a source of biodegradable chemical wash material, any or all alone and/or in combination with water to be directed to a dish in the dishwashers of the invention. Alternatively, another source of steam, plasma and/or biodegradable chemical wash material may be used and operated to apply the same to a dish or the like for at least partly contributing to washing or cleaning thereof. In the event steam is used, the steam may be low or high pressure.

Still further, using steam to clean and wash a dish provides both cleaning function and disinfecting function, e.g., to remove or to kill bacteria, etc. Using ultra-violet light (radiation) in addition to the steam may provide an additional disinfecting function. Thus, in some instances the combination of steam to clean, wash and disinfect along with ultra-violet illumination further to disinfect, may provide suitable dish washing functions without the need for washing with water and/or without the need for washing with detergent.

The dishwasher may be brushless, i.e., not have brushes to brush or to wipe against the face of the dish or the like. For example, if the steam or water is provided at adequately high pressure or flow rate against the dish or the like being cleaned, brushes may be unnecessary to wipe or to brush against the dish or the like to effect suitable cleaning. The steam temperature, pressure and/or flow rate may be adequate to effect the cleaning/washing of the dish or the like. Also, if the water or other fluid flowing against the dish or the like is of adequately high temperature and/or includes adequate washing agent, e.g., biodegradable chemical wash, brushes may be unnecessary to effect adequate cleaning/washing of the dish or the like.

It will be appreciated that dishwashers using features of the present invention may have a relatively fast throughput. A dish may be inserted into the entrance 21 (FIG. 1A, 1B or 9, for example, washed and removed from the exit 25 in a single action. Also, if suitable washing does not occur in a single pass through the dishwasher, the washing can be repeated, e.g., by reinserting the dish in the entrance 21, having it washed, and removing the dish from the exit. If desired, if less than all the washing functions of the dishwasher were used during the initial pass of a dish through the dishwasher, additional functions could be turned on for a subsequent pass, etc. After a dish has been washed and dried, it may be placed directly in a cabinet; there may be no need to load a conventional dishwasher rack and to unload that rack after a load of dishes has been washed. Water and power may be conserved using the dishwasher of the invention because there is no need to use all the water or power required to operate a conventional dishwasher if only a few dishes are being washed in the conventional dishwasher.

The invention claimed is:

1. A dishwasher comprising a cabinet having a dishwashing chamber in which a dish is washed, at least one fluid outlet to direct at least one of rinse water, wash water, steam or air toward a dish for washing and/or drying the dish, a dish inlet into the dishwashing chamber of a size and shape through which only one dish at a time can be inserted into the dishwashing chamber to be washed and/or dried by fluid provided into the dishwashing chamber adjacent the dish by the at least one outlet, the dish inlet being a slot-like opening in a wall of the dishwasher cabinet, the slot-like opening being of a size and shape to provide limited space for only one dish at a time to pass therethrough, and control and distribution for at least one of rinse water, wash water, steam and/or air.

2. The dishwasher of claim 1, wherein the dishwashing chamber comprises several chambers, each having its own dish inlet.

3. The dishwasher of claim 1, further comprising a transport system to transport a dish into and out from the dishwashing chamber.

4. The dishwasher of claim 1, further comprising a table or counter, the cabinet of the dishwasher being mounted with respect to the table or counter.

5. The dishwasher of claim 4, wherein the cabinet of the dishwasher has a stored position beneath the table or counter and a used position above the table or counter.

6. The dishwasher of claim 5, wherein the dishwashing chamber of the dishwasher is accessible while in a stored position beneath the table or counter.

7. The dishwasher of claim 1, wherein the cabinet includes a housing including the dishwashing chamber, a travel path through the housing and along which only one dish at a time may travel to be washed, a number of cleaning members in the housing to clean a dish moving through the housing along the travel path, said dish inlet comprising an inlet for passing a dish into the housing along the travel path and an outlet from the housing through which a dish may be removed from the housing, and wherein the distance between the inlet and outlet being such that a dish may be manually held both at the inlet and at the outlet while and during at least part of the process of passing the dish along the travel path in the housing for washing.

8. The dishwasher of claim 1, wherein the chamber includes a washing zone, and a path in which one dish at a time may be manually inserted to and removed from the washing zone.

9. The dishwasher of claim 8, wherein the outlet includes a fluid dispenser to dispense fluid to the dish for washing.

10. The dishwasher of claim 8, further comprising brushes for brushing against the dish in the washing zone.

11. The dishwasher of claim 8, further comprising a steam flow to direct a flow of steam to the dish at least to assist in cleaning.

12. The dishwasher of claim 8, further comprising a source of ultraviolet radiation providing ultraviolet radiation in the dishwashing chamber for irradiating a dish therein.

13. The dishwasher of claim 8, further comprising a biodegradable chemical wash for washing the dish in the washing zone.

14. The dishwasher of claim 8, further comprising a source of plasma for at least partly cleaning the dish in the washing zone.

15. The dishwasher of claim 8, further comprising a source of ultrasonic energy for at least partly cleaning the dish in the washing zone.

16. The dishwasher of claim 1 including a source of steam flow to the dishwashing chamber, and a water curtain for blocking flow of steam outside the dishwashing chamber.

17. The dishwasher of claim 16, the dishwashing chamber having a dish outlet for removing such dish from the dishwashing chamber, and said water curtain being at the dish inlet or dish outlet of the dishwashing chamber.

18. The dishwasher of claim 17, said water curtain comprising a flow of water for washing or rinsing a dish.

19. The dishwasher of claim 1, the dishwashing chamber including a washing zone and at least one steam zone for directing steam to a dish or other object for washing the same.

20. The dishwasher of claim 19, comprising at least two steam zones.

21. The dishwasher of claim 19, wherein the steam at the steam zone cleans the dish satisfactorily without the need for wash water or brushing.

22. The dishwasher of claim 19, wherein the steam zone is outside the dishwashing chamber.

23. The dishwasher of claim 22, said steam zone comprising a steam hose, a supply of steam, and a spray nozzle.

24. The dishwasher of claim 1, said dishwashing chamber including a washing zone and an air curtain to isolate the washing zone from the environment external of the dishwasher.

25. The dishwasher of claim 1, wherein the dishwashing cabinet includes a washing zone, and further comprising external of the housing a steam dispenser.

26. The dishwasher of claim 25, said steam dispenser comprising a hose, and a spray outlet.

27. The dishwasher of claim 1, wherein said slot-like opening of said dish inlet is configured to provide a space that limits dishes to pass therethrough substantially limited to only one dish at a time while minimizing splashing to the outside of the dishwasher.

28. The dishwasher of claim 1, wherein dish inlet provides both an entrance and exit for a dish into and out from the dishwashing chamber.

29. The dishwasher of claim 1, wherein the area of the slot-like opening is less than the area of the wall in which the slot-like opening is located.

30. The dishwasher of claim 1, wherein the slot-like opening is in a side wall of the dishwasher cabinet.

31. The dishwasher of claim 1, wherein the slot-like opening is in an end wall of the dishwasher cabinet.

32. The dishwasher of claim 1, wherein the slot-like opening is in a top wall of the dishwasher cabinet.

33. The dishwasher of claim 1, wherein the slot-like opening is of a size and shape to pass therethrough dishes of a generally planer shape.

* * * * *

UNITED STATES PATENT AND TRADEMARK OFFICE

CERTIFICATE OF CORRECTION

PATENT NO. : 7,604,012 B2
APPLICATION NO. : 10/926765
DATED : October 20, 2009
INVENTOR(S) : Alpert et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 972 days.

Signed and Sealed this

Fifth Day of October, 2010

David J. Kappos

David J. Kappos
*Director of the United States Patent and Trademark Office*